United States Patent [19]

Deguchi et al.

[11] Patent Number: 4,746,599

[45] Date of Patent: May 24, 1988

[54] SILVER HALIDE COLOR PHOTOSENSITIVE MATERIALS

[75] Inventors: Naoyasu Deguchi; Nobutaka Ohki, both of Minami-ashigara, Japan

[73] Assignee: Fuji Photo Film Co., Ltd., Kanagawa, Japan

[21] Appl. No.: 43,593

[22] Filed: Apr. 28, 1987

[30] Foreign Application Priority Data

May 1, 1986 [JP] Japan ..... 61-101683

[51] Int. Cl.[4] ..... G03C 7/26; G03C 7/18

[52] U.S. Cl. ..... 430/504; 430/506; 430/549

[58] Field of Search ..... 430/504, 505, 506, 549

[56] References Cited

U.S. PATENT DOCUMENTS 4,273,861 6/1981 Shiba et al. ..... 430/505

4,639,415 1/1987 Kaneko et al. ..... 430/505

4,707,436 11/1987 Sasaki ..... 430/504

*Primary Examiner*—Richard L. Schilling

*Attorney, Agent, or Firm*—Burns, Doane, Swecker & Mathis

[57] ABSTRACT

The present invention relates to silver halide color photosensitive materials having improved tone and color reproductions. According to the present invention, there is provided a silver halide color photosensitive material wherein a coupler having the following general formula (I) is contained in a green-sensitive material and wherein a cyan gradation added to a specific image of a region in which a yellow and/or magenta image density obtained by color development exceeds 0.7, so as to increase cyan image gradation in the specific image region independently of the cyan density in a cyan coloring red-sensitive layer and as the yellow and/or magenta image density in the specific image region increases. Formula (I):

(I)

wherein $R_{11}$ represents a hydrogen atom or a substituent, X represents a hydrogen atom or a group which can be released upon a coupling reaction with an oxidized product of an aromatic primary amine developing agent, and Za, Zb and Zc each represents a methine, substituted methine, =N— or —NH— group; one of the Za-Zb bond and Zb-Zc bond is a double bond and the other is a single bond; when Zb-Zc is a carbon-to-carbon double bond, it may compose a part of a condensed aromatic bond; $R_{11}$ or X may form a higher polymer including a dimer or more; and when Za, Zb or Zc is the substituted methine, a higher polymer including a dimer or more may be formed through the substituted methine.

11 Claims, No Drawings

SILVER HALIDE COLOR PHOTOSENSITIVE MATERIALS

FIELD OF THE INVENTION

The present invention relates to a silver halide color photosensitive material capable of forming an image having an improved quality. In particular, the present invention relates to a silver halide color photosensitive material capable of providing improved tone reproduction and color reproduction.

BACKGROUND OF THE INVENTION

Silver halide color photosensitive materials (hereinafter referred to as "photosensitive material") usually comprise, on a support, light-sensitive layers each having a different color sensitivity and each containing a given photographic dye-forming agent. Processes for forming a color photographic image from such a silver halide color photosensitive material can be roughly classified into an additive color process and subtractive color process. In the latter process which is conducted according to a color development method, usually photographic couplers for three colors, i.e. yellow, magenta and cyan, are contained in the photosensitive layers and the sensitive materials are subjected to the color development process with a color developing agent after the imagewise exposure. In the color development process, an aromatic primary amine of the color developing agent is subjected to an oxidative coupling reaction with the photographic coupler to produce an indophenol or azomethine coloring dye.

It has eagerly been demanded to develop such a silver halide color photosensitive material capable of providing a high saturation and a delicate shade or shadow (herein referred to merely as shade) without reducing the color reproduction.

However, it has been thought that increases in both the saturation and the reproduction of the delicate shade cannot be obtained at the same time.

Namely, for increasing the saturation, a coloring dye having unnecessary absorption as small as possible is required, or it is necessary to reduce the unnecessary absorption as much as possible. On the other hand, the unnecessary absorption contributes to the shade formation. When the absorption is reduced as much as possible, the delicate shade cannot be expressed and also a sufficient color reproduction cannot be attained.

Generally, the cyan dye has unnecessary absorption of the magenta component or yellow component, and the magenta dye has unnecessary absorption of the yellow component or cyan component. This deteriorates the color reproduction of an object having a high saturation. In order to overcome the deterioration of the color reproduction due to the unnecessary absorption, a process for improving the interimage or interlayer effect in the development step is employed. However, this process has a problem that a delicate shade cannot be reproduced because the unnecessary absorption which contributes to the shade formation is also suppressed in a high density region, although the color reproduction with regard to the saturation is possible in low and medium density regions.

SUMMARY OF THE INVENTION

An object of the present invention is to provide a silver halide color photosensitive material capable of providing a high saturation without reducing the color reproduction in particularly low and medium density regions of red and magenta, and an excellent and delicate shade reproduction in a high density region.

Under these circumstances, the present inventors have made intensive studies and, as a result, found out that this object can be attained by a silver halide color photosensitive material comprising, on a support, at least one cyan coloring red-sensitive silver halide emulsion layer, at least one magenta coloring green-sensitive silver halide emulsion layer, and at least one yellow coloring blue-sensitive silver halide emulsion layer, at least one coupler represented by the following general formula (I) being contained in at least one green-sensitive emulsion layer, and a cyan gradation being added to a specific image of a region in which the yellow and/or magenta image density obtained by the color development exceeds 0.7, so as to increase cyan gradation in the specific image region independently of the cyan density of the cyan coloring red-sensitive layer, and as the yellow and/or magenta image density in the specific image region increases. Formula (I):

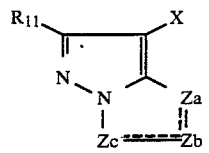

(I)

wherein $R_{11}$ represents a hydrogen atom or a substituent, X represents a hydrogen atom or a group which can be released upon a coupling reaction with an oxidized product of an aromatic primary amine developing agent, and Za, Zb and Zc each represents a methine, substituted methine, =N— or —NH— group; one of the Za-Zb bond and Zb-Zc bond is a double bond and the other is a single bond, when Zb-Zc is a carbon-to-carbon double bond; it may compose a part of a condensed aromatic bond; $R_{11}$ or X may form a higher polymer including a dimer or more; and when Za, Zb or Zc is the substituted methine, a higher polymer including a dimer or more may be formed through the substituted methine.

The description will be made on that the cyan density is increased in a density region in which the yellow and/or magenta image density exceeds 0.7 by the color development, independently of the color density in the cyan coloring red-sensitive layer, as the yellow and/or magenta image density is increased.

In the silver halide color photosensitive material comprising, on a support, at least one cyan coloring red-sensitive silver halide emulsion layer, at least one magenta coloring green-sensitive silver halide emulsion layer, and at least one yellow coloring blue-sensitive silver halide emulsion layer, the cyan gradation is provided by the coloring of the red-sensitive emulsion layer. When the degree of the color development in the green-sensitive or blue-sensitive emulsion layer adjacent to the red-sensitive emulsion layer is large and that of the red-sensitive layer is small, the cyan coloring occurs also by the color mixing occurring because an oxide of the developing agent formed in the emulsion layer adjacent to the red-sensitive layer is diffused into the red-sensitive layer.

However, the cyan coloring density is closely related to the coloring density in the cyan coloring red-sensitive layer. Further, the higher the coloring density in the emulsion layer adjacent to the red-sensitive layer, the more serious the color mixing in the cyan coloring.

According to the present invention, the cyan density is increased in a density region in which the yellow and/or magenta image density exceeds 0.7 by the color development, independently of the color density in the cyan coloring red-sensitive layer as the yellow and/or magenta image density is increased. The mechanism of the present invention is utterly different from that of the above-described color mixing or the cyan coloring in the red-sensitive emulsion layer.

When a 5-pyrazolone coupler is used as the coupler for magenta, a bright and vivid color of low or medium density of magenta or red cannot be reproduced and an undesirable color having a low saturation is reproduced, due to the unnecessary absorptions of yellow and cyan components.

On the contrary, when the magenta coupler of the general formula (I) of the present invention is used, the colored dye provides preferred results with regard to the magenta and red color reproduction, particularly a high saturation, since its yellow component (short-wave region) content and cyan component (long-wave region) content are smaller than those of the dye coupled with the 5-pyrazolone coupler. However, an undesirable result, i.e. so-called gradation loss is provided. Namely, the delicate shade cannot be reproduced, because the cyan component is insufficient in the high density region and shade parts.

When the magenta coupler of general formula (I) is used and the cyan gradation is added to the density region in which the yellow or magenta image density exceeds 0.7 by the color development, the cyan gradation is added to the high density region and shade parts (namely, gradation loss is improved) while the color reproduction of light and vivid magenta and red is assured. The density region in which the cyan gradation is to be added is preferably a region in which the yellow and/or magenta density exceeds 1.0, particularly 1.2. The maximum density of the cyan gradation to be added is preferably 0.05 to 0.50, particularly 0.10 to 0.40. The coloring dye to which the cyan gradation is to be added is magenta rather than yellow.

The couplers to be used are represented by the following general formula (I):

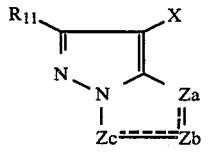

wherein $R_{11}$ represents a hydrogen atom or a substituent, X represents a hydrogen atom or a group which can be released by the coupling reaction with an oxidized aromatic primary amine developing agent, and Za, Zb and Zc each represents a methine, substituted methine, =N— or —NH— group; one of the Za-Zb bond and Zb-Zc bond is a double bond and the other is a single bond; when Zb-Zc is a carbon-to-carbon double bond, it may compose a part of a condensed aromatic bond; $R_{11}$ or X may form a higher polymer including a dimer or more; and when Za, Zb or Zc is the substituted methine, a higher polymer including a dimer or more may be formed with the substituted methine.

The term "polymer" defined in the general formula (I) means a compound having two or more groups of the general formula (I) in the molecule. The polymer includes a bis-compound or a polymer coupler. The polymer coupler herein may be a homopolymer singly comprising a monomer having a part of the general formula (I) (preferably, the monomer has a vinyl group; hereinafter referred to as "vinyl monomer") or a copolymer thereof with a non-coloring ethylenic monomer which is not coupled with the oxidized aromatic primary amine developing agent.

Among the pyrazoloazole magenta couplers of the general formula (I), preferred are those of the following general formulae (II), (III), (IV), (V), (VI), (VII) and (VIII):

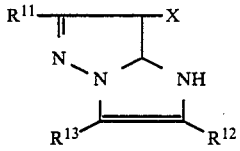

(II)

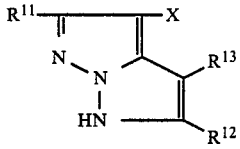

(III)

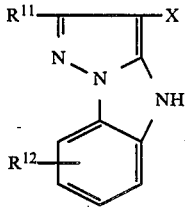

(IV)

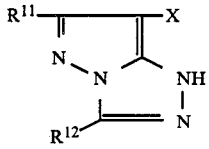

(V)

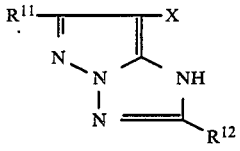

(VI)

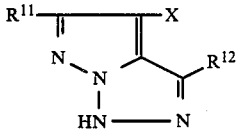

(VII)

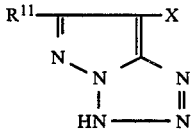

(VIII)

In the above general formulae (I) through (VIII), $R^{11}$, $R^{12}$ and $R^{13}$ may be the same or different and each represents a hydrogen atom, a halogen atom or an alkyl, aryl, heterocyclic, cyano, alkoxy, aryloxy, heterocyclic oxy, acyloxy, carbamoyloxy, silyloxy, sulfonyloxy, acylamino, anilino, ureido, imido, sulfamoylamino, carbamoylamino, alkylthio, arylthio, heterocyclic thio, alkoxycarbonylamino, aryloxycarbonylamino, sulfonamido, carbamoyl, acyl, sulfamoyl, sulfonyl, sulfinyl, alkoxycarbonyl or aryloxycarbonyl group, and X represents a hydrogen atom, a halogen atom, a carboxy group or a group capable of bonding with a carbon atom at the coupling position through an oxygen atom, nitrogen atom or sulfur atom which group can be released by the coupling, or $R^{11}$, $R^{12}$, $R^{13}$ or X may be a divalent group to form a bis-compound.

In the polymer coupler, the coupler residues of general formulae (II) to (VIII) may be present in the main chain or side chain of the polymer. Particularly, the polymer derived from a vinyl monomer containing a moiety represented by the general formula is preferable, in this case, $R^{11}$, $R_{12}$, $R^{13}$ or X represents a vinyl group or a coupling group.

Particularly speaking, $R^{11}$, $R^{12}$ and $R^{13}$ each represents a hydrogen atom, halogen atom (such as chlorine or bromine atom), alkyl group (such as butyl, propyl, isopropyl, t-butyl, trifluoromethyl, tridecyl, 2-[α-{3-(2-octyloxy-5-tert-octylbenzenesulfonamido)phenoxy}tetradecaneamido]ethyl, 3-(2,4-di-t-amylphenoxy)propyl, allyl, 2-dodecyloxyethyl, 1-(2-octyloxy-5-tert-octylbenzenesulfonamido)-2-propyl, 1-ethyl-1-{4-(2-butoxy-5-tert-octylbenzenesulfonamido)phenyl}methyl, 3-phenoxypropyl, 2-hexylsulfonylethyl, cyclopentyl or benzyl group), aryl group (such as phenyl, 4-t-butylphenyl, 2,4-di-t-amylphenyl or 4-tetradecaneamidophenyl group), heterocyclic group (such as 2-furyl, 2-thienyl, 2-pyrimidinyl or 2-benzothiazolyl group), cyano group, alkoxy group (such as methoxy, ethoxy, 2-methoxyethoxy, 2-dodecyloxyethoxy or 2-methanesulfonylethoxy group), aryloxy group (such as phenoxy, 2-methylphenoxy or 4-t-butylphenoxy group), heterocyclic oxy group (such as 2-benzimidazolyloxy group), acyloxy group (such as acetoxy or hexadecanoyloxy group), carbamoyloxy group (such as N-phenylcarbamoyloxy or N-ethylcarbamoyloxy group), silyloxy group (such as trimethylsilyloxy group), sulfonyloxy group (such as dodecylsulfonyloxy group), acylamino group (such as acetamido, benzamido, tetradecaneamido, α-(2,4-di-t-amylphenoxy)butylamido, γ-(3-t-butyl-4-hydroxyphenoxy)butylamido or α-{4-(4-hydroxyphenylsulfonyl)phenoxy}decaneamido group), anilino group (such as phenylamino, 2-chloroanilino, 2-chloro-5-tetradecaneamidoanilino, 2-chloro-5-dodecyloxycarbonylanilino, N-acetylanilino or 2-chloro-5-{α-(3-t-butyl-4-hydroxyphenoxy)-dodecaneamino}anilino group), ureido group (such as phenylureido, methylureido or N,N-dibutylureido group), imido group (such as N-succinimido, 3-benzylhydantoinyl or 4-(2-ethylhexanoylamino)phthalimido group), sulfamoylamino group (such as N,N-dipropylsulfamoylamino or N-methyl-decylsulfamoylamino group), alkylthio group (such as methylthio, octylthio, tetradecylthio, 2-phenoxyethylthio, 3-phenoxypropylthio or 3-(4-t-butylphenoxy)propylthio group), arylthio group (such as phenylthio, 2-butoxy-5-t-octylphenylthio, 3-pentadecylphenylthio, 2-carboxyphenylthio or 4-tetradecaneamidophenylthio group), heterocyclic thio group (such as 2-benzothiazolylthio group), alkoxycarbonylamino group (such as methoxycarbonylamino or tetradecyloxycarbonylamino group), aryloxycarbonylamino group (such as phenoxycarbonylamino or 2,4-di-tert-butylphenoxycarbonylamino group), sulfonamido group (such as methanesulfonamido, hexadecanesulfonamido, benzenesulfonamido, p-toluenesulfonamido, octadecanesulfonamido or 2-methyloxy-5-t-butylbenzenesulfonamido group), carbamoyl group (such as N-ethylcarbamoyl, N,N-dibutylcarbamoyl, N-(2-dodecyloxyethyl)carbamoyl, N-methyl-N-dodecylcarbamoyl, or N-{3-(2,4-di-tert-amylphenoxy)propyl}carbamoyl group), acyl group (such as acetyl, (2,4-di-tert-amylphenoxy)acetyl or benzoyl group), sulfamoyl group (such as N-ethylsulfamoyl, N,N-dipropylsulfamoyl, N-(2-dodecyloxyethyl)sulfamoyl, N-ethyl-N-dodecylsulfamoyl or N,N-diethylsulfamoyl group), sulfonyl group (such as methanesulfonyl, octanesulfonyl, benzenesulfonyl or toluenesulfonyl group), sulfinyl group (such as octanesulfinyl, dodecylsulfinyl or phenylsulfinyl group), alkoxycarbonyl group (such as methoxycarbonyl, butyloxycarbonyl, dodecylcarbonyl or octadecylcarbonyl group), or aryloxycarbonyl group (such as phenyloxycarbonyl or 3-pentadecyloxycarbonyl group); and X represents a hydrogen atom, a halogen atom (such as chlorine, bromine or iodine atom), a carboxy group, a group to be bonded through an oxygen atom (such as acetoxy, propanoyloxy, benzoyloxy, 2,4-dichlorobenzoyloxy, ethoxooxaloyloxy, pyruvinyloxy, cinnamoyloxy, phenoxy, 4-cyanophenoxyl, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy or 2-benzothiazolyloxo group), a group to be bonded through a nitrogen atom (such as benzenesulfonamido, N-ethyltoluenesulfonamido, heptafluorobutaneamide, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzylethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazol-1-yl, 5- or 6-bromobenzotriazol-1-yl, 5-methyl-1,2,3,4-triazol-1-yl, benzimidazolyl, 3-benzyl-1-hydantoinyl, 1-benzyl-5-hexadecyloxy-3-hydantoinyl or 5-methyl-1-tetrazolyl group), an arylazo group (such as 4-methoxyphenylazo, 4-pivaloylaminophenylazo, 2-naphthylazo or 3-methyl-4-hydroxyphenylazo group), or a group to be bonded through a sulfur atom (such as phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio or 2-phenyl-3-dodecyl-1,2,4-triazole-5-thio group).

In the couplers of the general formulae (II) and (II), $R^{12}$ and $R^{13}$ may be combined to form a five-membered to seven-membered ring.

When $R^{11}$, $R^{12}$, $R^{13}$ or X is a divalent group to form a bis-compound, $R^{11}$, $R^{12}$ or $R^{13}$ preferably represents a substituted or unsubstituted alkylene group (such as methylene, ethylene, 1,10-decylene or $—CH_2CH_2—O—CH_2CH_2—$group), a substituted or unsubstituted phenylene group (such as 1,4-phenylene, 1,3-phenylene,

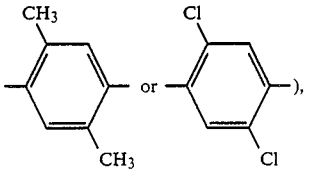

—NHCO—$R^{14}$—CONH— wherein $R^{14}$ represents a substituted or unsubstituted alkylene or phenylene group (such as —$NHCOCH_2CH_2$—CONH—,

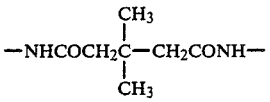

or

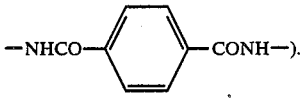

—S—$R^{14}$—S— group wherein $R^{14}$ represents a substituted or unsubstituted alkylene group (such as

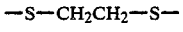

or

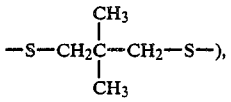

and X represents a divalent group derived from the above-mentioned monovalent group.

When a group derived from the compound of the above general formula (II), (III), (IV), (V), (VI), (VII) or (VIII) is contained in the vinyl monomer, the bonding group represented by $R^{11}$, $R^{12}$, $R^{13}$ or X may also be selected from the group consisting of alkylene groups (substituted or unsubstituted alkylene groups such as methylene, ethylene, 1,10-decylene and —$CH_2CH_2OCH_2CH_2$— groups), phenylene groups (substituted or unsubstituted phenylene groups such as 1,4-phenylene, 1,3-phenylene,

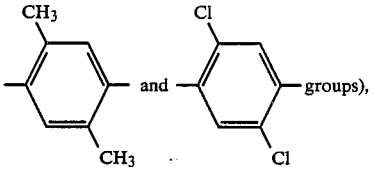

—NHCO—, —CONH—, —O—, —OCO— and aralkylene groups (such as

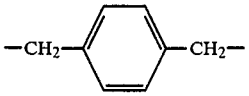

-continued

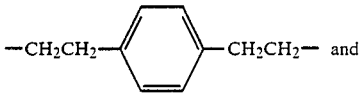

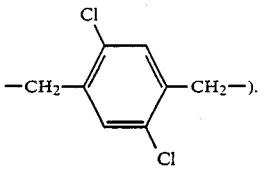

Preferred bonding groups are as follows:

—NHCO—, —$CH_2CH_2$—,

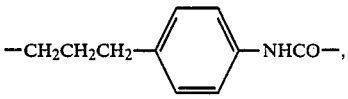

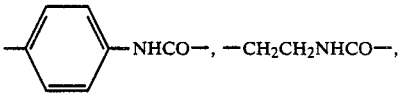

—$CH_2CH_2$—O—C(=O)—,

—CONH—$CH_2CH_2$NHCO—,
—$CH_2CH_2$O—$CH_2CH_2$—NHCO—, and

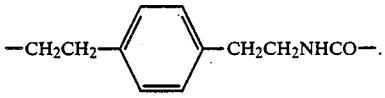

The vinyl group may have a substituent in addition to the group represented by the general formula (II), (III), (IV), (V), (VI), (VII) or (VIII). Preferred substituents are hydrogen atom, chlorine atom and lower alkyl groups having 1 to 4 carbon atoms such as methyl and ethyl groups.

The monomer containing the substituent of the general formula (II), (III), (IV), (V), (VI), (VII) or (VIII) may form a copolymer with a non-coloring ethylenic monomer which is not coupled with the oxidation product of the aromatic primary amine developing agent.

Examples of the non-coloring ethylenic monomers which are not coupled with the oxidation product of the aromatic primary amine developing agent include acrylic acid, α-chloroacrylic acid, α-alkylacrylic acids (such as methacrylic acid) and esters and amides derived from these acrylic acids (such as acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxy methacrylate), methylenedibisacrylamide, vinyl esters (such as vinyl acetate, vinyl propionate and vinyl laurate), acrylonitrile, methacrylonitrile, aromatic vinyl compounds (such as styrene and its derivatives, vinyltoluene, divinylbenzene, vinylacetophenone and sulfostyrene), itaconic acid, citraconic acid, crotonic acid, vinylidene chloride, vinyl alkyl ethers (such as vinyl ethyl ether), maleic acid, maleic anhydride, maleic esters, N-vinyl-2-pyrrolidone, N-vinylpyridine and 2- and 4-vinylpyridines. The non-coloring ethylenic unsaturated monomers may be used either singly or as a combination of them. The combinations are, for example, n-butyl acrylate/methyl acrylate, styrene/methacrylic acid, methacrylic acid/acrylic amide and methyl acrylate/-diacetoneacrylamide.

As is well known in the field of the polymer color couplers, the non-coloring ethylenic unsaturated monomer to be copolymerized with the solid, water-insoluble monomer coupler can be selected so as to exert a good influence on the physical properties and/or chemical properties such as the solubility, compatibility with the binder (e.g. gelatin) in the photographic colloid composition, flexibility and thermal stability, of the formed copolymer.

It is particularly preferable that the polymer couplers to be used in the present invention be polymer coupler latexes.

Examples of the pyrazoloazole magenta couplers of the above general formula (I) to be used in the present invention and processes for the preparation of them are described in, for example, Japanese Patent Publication Disclosure Nos. 59-162548, 60-43659, 59-171956, 60-33552 and 60-172982 and U.S. Pat. No. 3,061,432.

Typical examples of the magenta couplers according to the present invention and the vinyl monomers will be given below, which by no means limit the scope of the present invention:

M-1

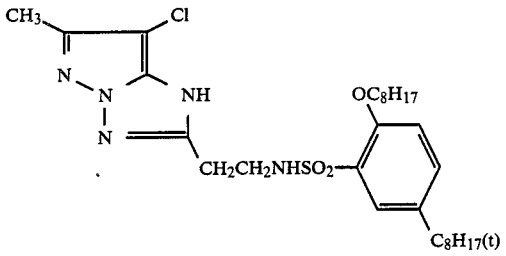

M-2

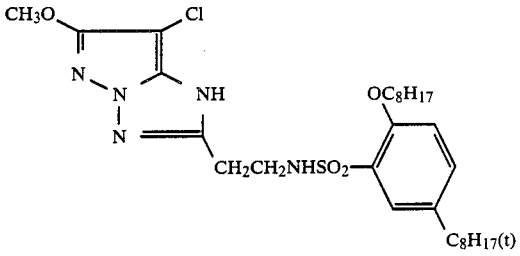

M-3

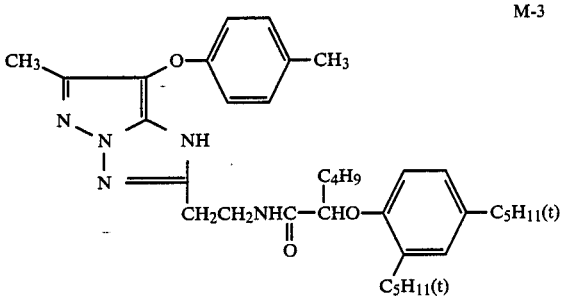

M-4

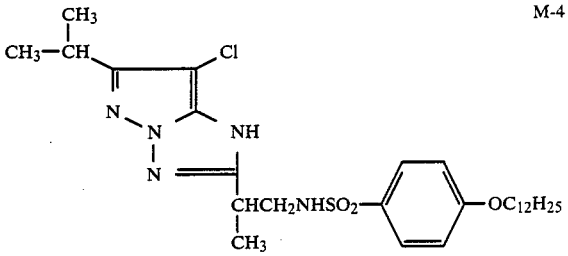

M-5

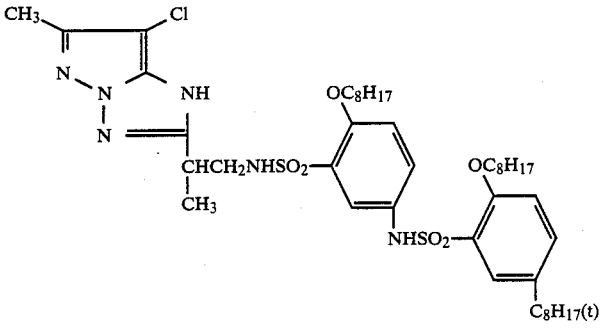

M-6

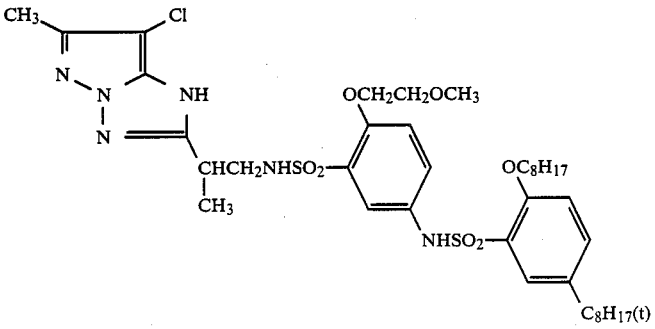

-continued
M-7
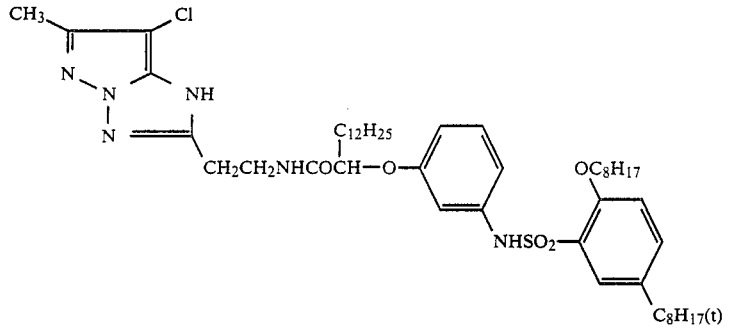
M-8
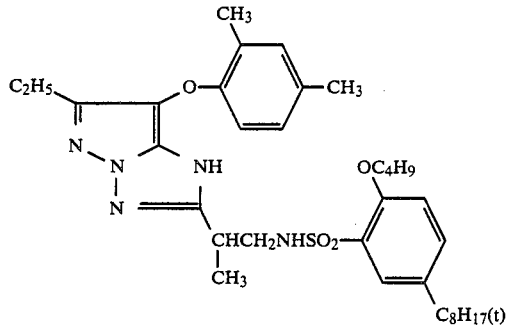
M-9
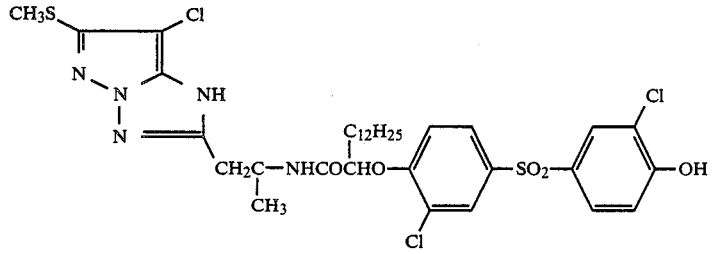
M-10
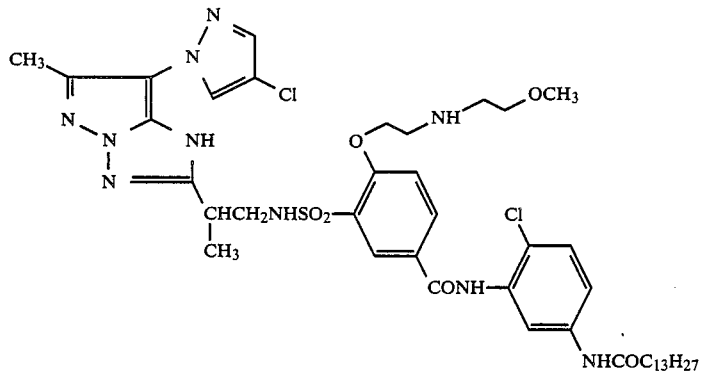
M-11
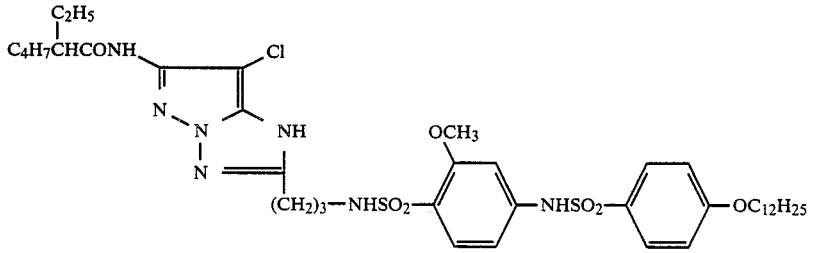

-continued
M-12
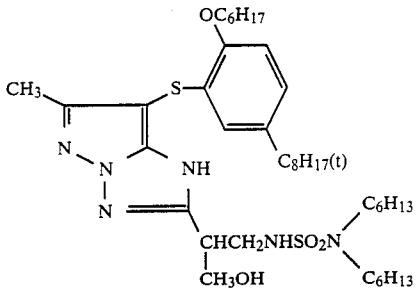
M-13
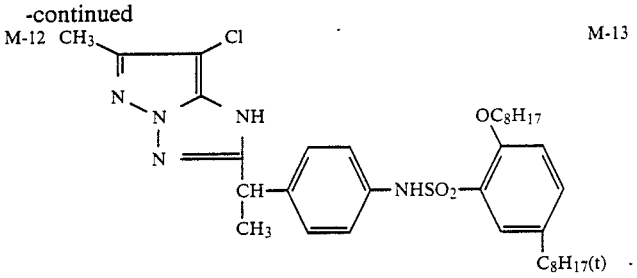
M-14
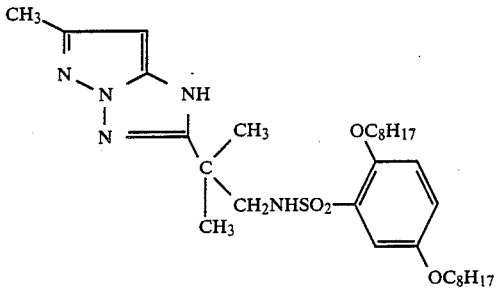
M-15
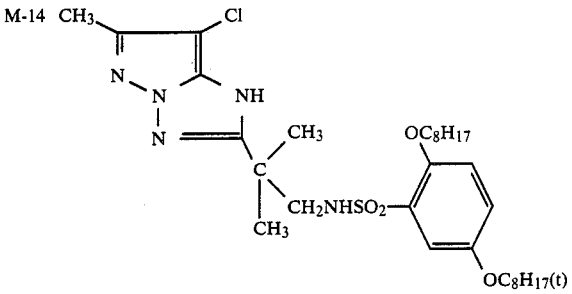
M-16
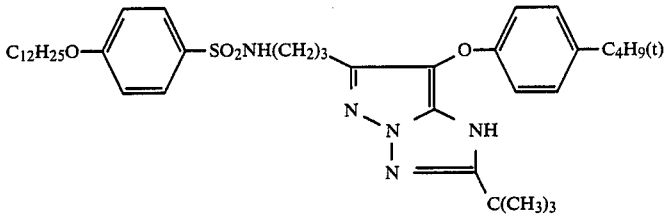
M-17
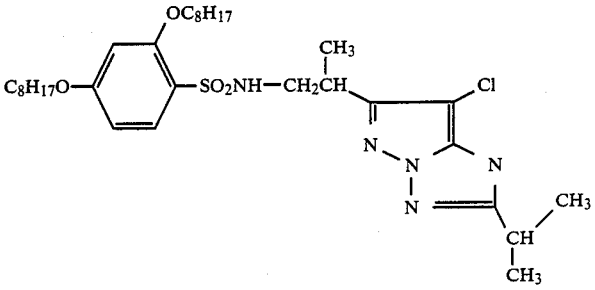
M-18
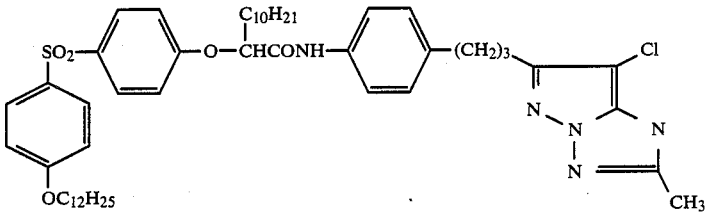
M-19
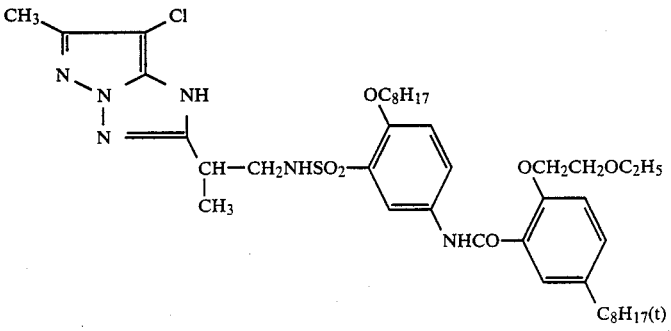

-continued
M-20
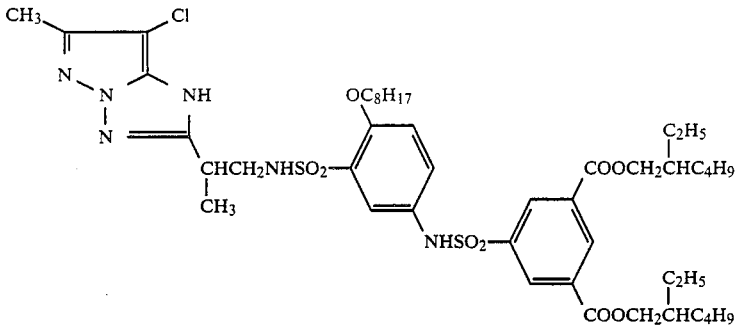
M-21
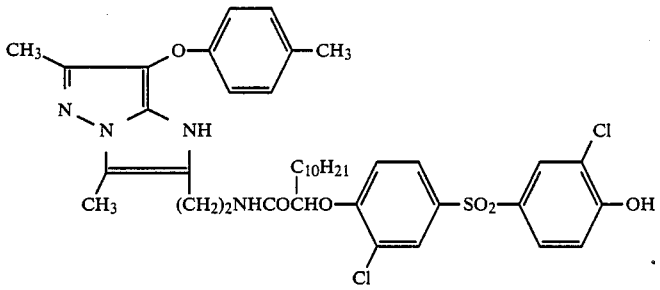
M-22
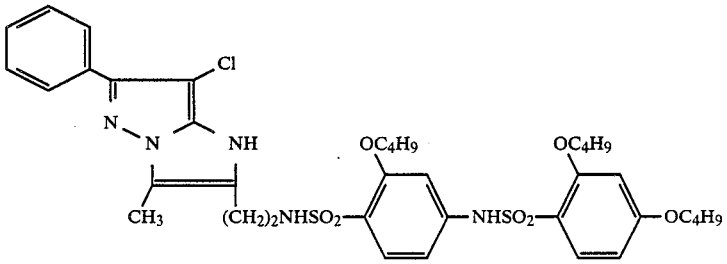
M-23
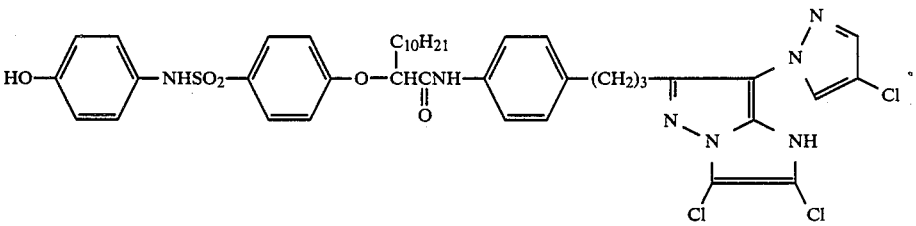
M-24
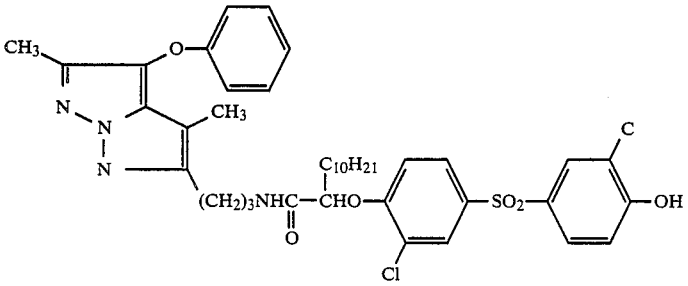

-continued
M-25
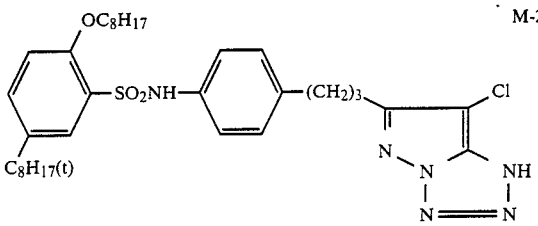
M-26
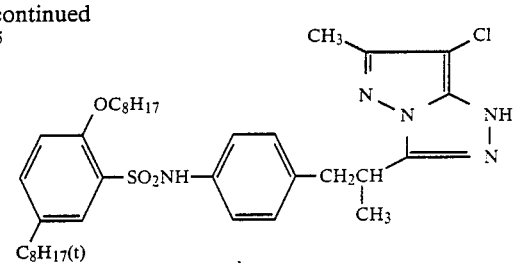
M-27
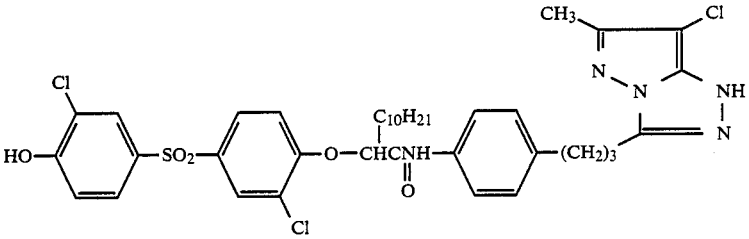
M-28
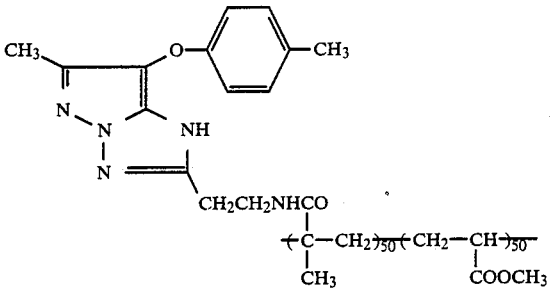
M-29
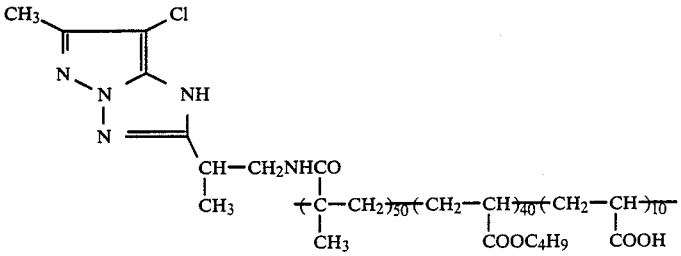
M-30
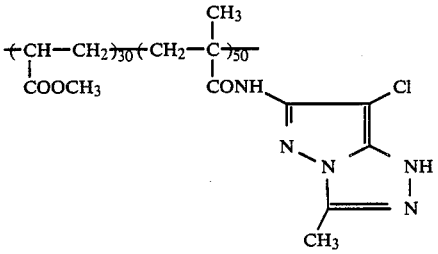
M-31
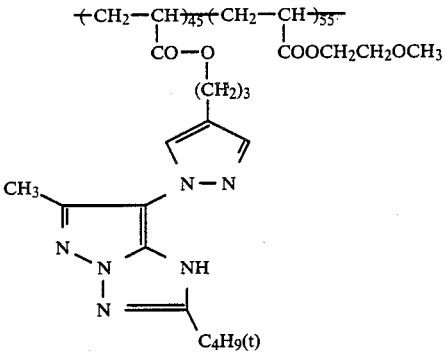
M-32
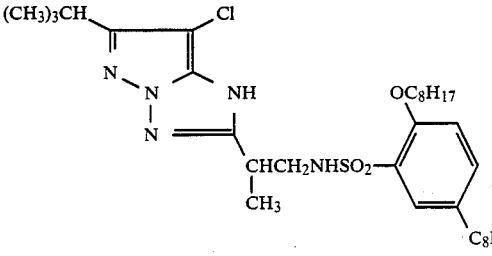
M-33
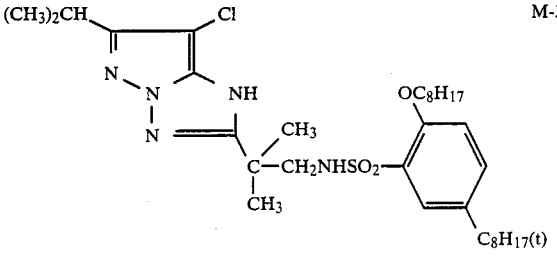

-continued
M-34
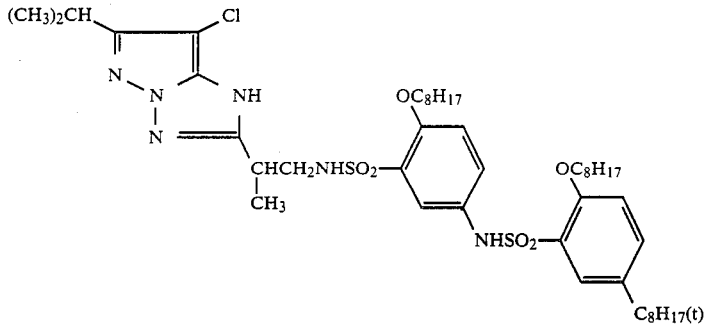
M-35
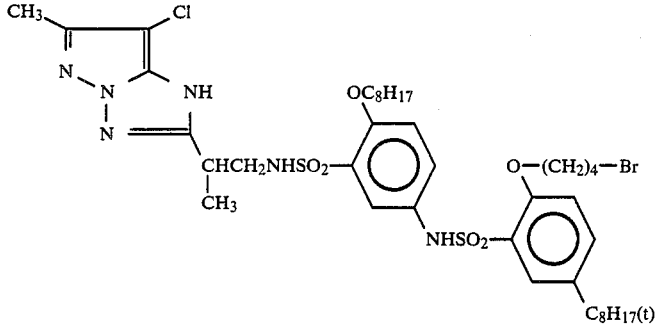
M-36
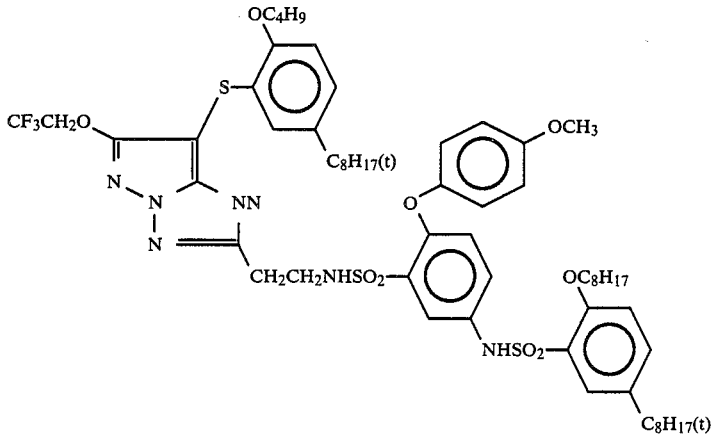
M-37
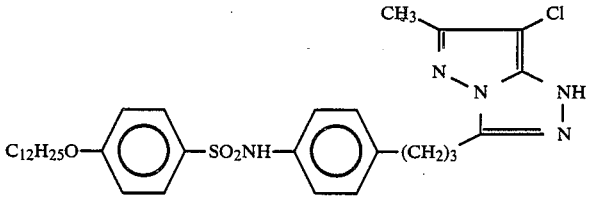
M-38
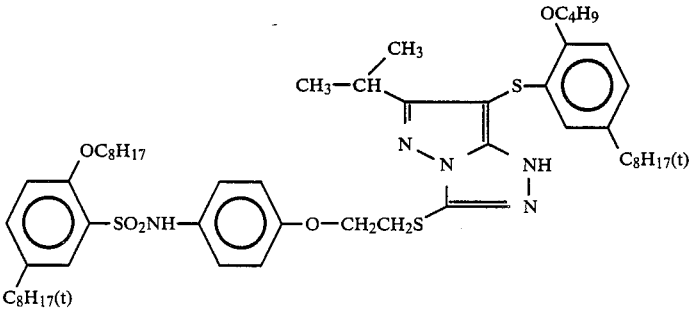

-continued

M-39

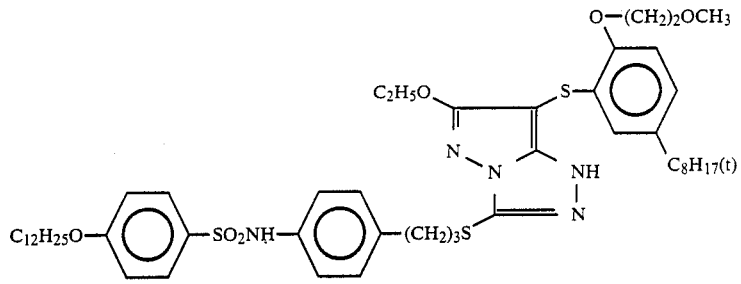

The preferred heterocyclic skeletal structures of the pyrazoloazole couplers of the general formula (I) are shown by the general formulae (II) through (VII). Among them, those of the general formulae (II), (III), (IV) and (V) are preferred with respect to the hue. The effects of them with respect to the hue are increased in the following order: (II)<(III)<(IV)<(V). The compounds of the general formulae (II), (III), (V) and (VI) are superior to those of the general formulae (IV) and (VII) with respect to the fastness, particularly light fastness, of the coloring dye. Particularly, the compounds of the general formula (V) provide excellent hue and fastness.

The coupler of the general formula (I) of the present invention is added to an emulsion layer in an amount of $1\times10^{-3}$ mol, preferably $5\times10^{-2}$ to $5\times10^{-1}$ mol, per mol of the silver halide contained in the layer. Two or more couplers of the present invention can also be added to the emulsion layer.

The practical embodiments of the structure of the silver halide color photosensitive material satisfying the requirements for attaining the object of the present invention are as follows:

EXAMPLE 1

A silver halide color photosensitive material comprising, on a support, at least one cyan coloring red-sensitive layer, at least one magenta coloring red-sensitive layer and at least one yellow coloring blue-sensitive layer, wherein at least one of the couplers of the general formula (I) is contained in at least one green-sensitive layer, and a cyan coloring coupler is contained in at least one of the green-sensitive layers and/or blue-sensitive layers and/or a non-photosensitive layer adjacent thereto.

EXAMPLE 2

A silver halide color photosensitive material comprising at least two magenta-coloring green-sensitive layers and/or at least two yellow coloring blue-sensitive layers, wherein a cyan-coloring coupler is contained in the green-sensitive layer bearing the tone reproduction in the highest density region and/or blue-sensitive layer and/or a non-photosensitive layer adjacent thereto.

EXAMPLE 3

The silver halide color photosensitive material of Examples 1 and 2, wherein the relative coupling rate of the cyan-coloring coupler contained in the green-sensitive layer and/or the blue-sensitive layer and/or the non-photosensitive layer adjacent thereto to the main coupler contained in the emulsion layer is 0.7 to 0.01.

EXAMPLE 4

A silver halide color photosensitive material comprising, on a support, at least one cyan-coloring red-sensitive layer, at least one magenta-coloring red-sensitive layer and at least one yellow-coloring blue-sensitive layer, wherein at least one of the couplers of the general formula (I) is contained in at least one green-sensitive layer, and at least one cyan-coloring coupler is contained in a green-sensitive layer or blue-sensitive layer in addition to the above-described photosensitive emulsion layers.

EXAMPLE 5

The silver halide color photosensitive material of Examples 1, 2, 3 and 4, wherein the cyan gradation to be added to a region of a yellow and/or magenta image density of above 0.7 by the color development is provided by at least one blue coloring coupler having the absorption maximum in a spectral wave length region of 570 to 649 nm in place of the cyan coloring coupler.

EXAMPLE 6

The silver halide color photosensitive material of Examples 1, 2, 3 and 4, wherein the cyan gradation to be added to a region of a yellow and/or magenta image density of above 0.7 by the color development is provided by at least one black coloring coupler of the general formula (IX) in place of the cyan coloring coupler.

EXAMPLE 7

A silver halide color photosensitive material comprising, on a support, at least one cyan-coloring red-sensitive layer, at least one yellow-coloring blue-sensitive layer and at least two magenta-coloring green-ensitive layers having different sensitivities, wherein the coupler of the general fromula (I) bromides at least 70% of the color density obtained by both of the coupler of the general formula (I) and the 5-pyrazolone magenta-coloring coupler in the green-sensitive layer concerning the tone reproduction in the lowest density part, and wherein the 5-pyrazolone magenta coupler provides at least 70% of the color density obtained by both of the coupler of the general formula (I) and the 5-pyrazolone magenta color coupler in the green-sensitive layer concerning the tone reproduction in the highest density part.

Typical examples of the 5-pyrazolone couplers are described in U.S. Pat. Nos. 2,311,082, 2,343,703, 2,600,788, 2,908,573, 3,062,653, 3,152,896 and 3,936,015. As the release groups of the 2-equivalent 5-pyrazoline couplers, nitrogen atom release groups described in U.S. Pat. No. 3,310,619 or arylthio groups described in U.S. Pat. No. 4,351,897 are particularly preferred.

When a 5-pyrazolone coupler having a ballast group described in European Pat. No. 73,636 is used, a high color density can be provided.

The relative coupling rate of the cyan coupler or magenta coupler is represented by RM/RN and that the yellow coupler, or cyan coupler having a phenolic coupler having a ureido group in position 2 is represented by Rc/Ro, as will be described below.

Now, the description will be made on the determination method of the RM/RN value.

The coupling reactivity of a coupler is represented as a relative value determined by adding, to an emulsion, a mixture of two couplers M and N which provide different dyes clearly separable from each other, subjecting the emulsion to the color development, and measuring the amounts of the respective dyes in the form color image.

RM/RN, i.e. the reactivity ratio of the two couplers, can be represented by the following formula:

$$\frac{RM}{RN} = \frac{\log\left(1 - \frac{DM}{(DM)_{max}}\right)}{\log\left(1 - \frac{DN}{(DN)_{max}}\right)}$$

wherein $(DM)_{max}$ represents the maximum color density of the coupler M, DM represents an intermediate color density, and $(DN)_{max}$ and DN respectively represent those of the coupler N.

In this case, the emulsion containing the coupler mixture is exposed stepwise and then subjected to the color development. Several values of DM and DN thus obtained are plotted as $\log[1-DM/(DM)_{max}]$ on a graph of two axes crossing at right angles. The coupling reactivity ratio RM/RN is determined from the gradient of the straight line formed in the graph.

RM/RN values of the couplers are determined by using a given coupler N. The relative coupling reactivity, i.e. coupling rate, is thus determined.

In case of the yellow couplers and specific cyan couplers of the phenol type having a ureido group in position 2, the determination of the reactivities thereof by using the comparative coupler (Coupler N) as described above are not preferred, since their reactivity and hue are changed depending on the kind and amount of oil to be used. The reactivities of the yellow couplers and the specific cyan couplers of the phenol type having a ureido group in position 2 are determined as follows:

The sample of the coupler to be tested is singly added to an emulsion to produce a sample, which is exposed and color-developed. The maximum density of the color image is referred to as $(DO)_{max}$. On the other hand, the sample is treated with a color developer containing 1.5 g, per liter, of citrazinic acid and the maximum density of the formed color image is referred to as $(Dc)_{max}$.

The coupling coloring property Rc/Ro of the coupler can be represented by $(Dc)_{max}/(Do)_{max}$.

In this case, the black coloring coupler used in the above Example 6 is shown by the following formula (IX):

General formula (IX)

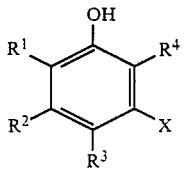

wherein X represents a hydroxyl group or

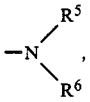

$R^1$ and $R^3$ each represents a hydrogen atom, a substituted or unsubstituted alkyl, acyl, sulfonyl, amido, carbamoyl, ureido, sulfonamido, alkoxycarbonyl or aryloxycarbonyl group, or a group which can be released by the coupling reaction with the aromatic primary amine developing agent, $R^2$ and $R^4$ each represents a hydrogen atom, a halogen atom or a substituted or unsubstituted alkyl, alkoxy, alkylthio, acyl, sulfonyl, amido, carbamoyl, ureido, sulfonamido, alkoxycarbonyl or aryloxycarbonyl group, and $R^5$ and $R^6$ each represents a hydrogen atom or a substituted or unsubstituted alkyl, aryl, alkenyl or heterocyclic group, the total carbon number of $R^1$ to $R^6$ being at least 8 and at least one of $R^1$ and $R^3$ being a hydrogen atom or a group which can be released by the coupling reaction with the aromatic primary amine developing agent.

Preferred examples of the black coloring couplers are as follows:

IX-1

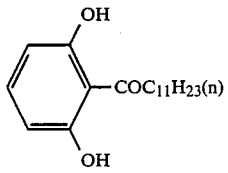

IX-2

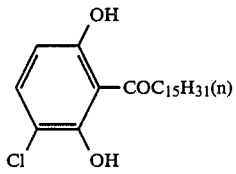

IX-3

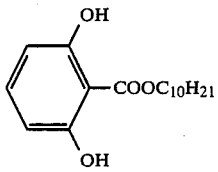

IX-4

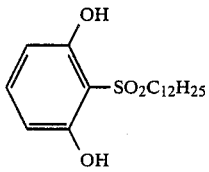

-continued

IX-5

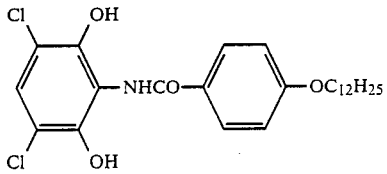

IX-6

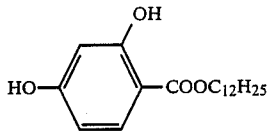

IX-7

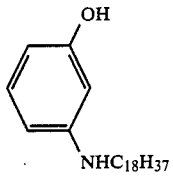

IX-8

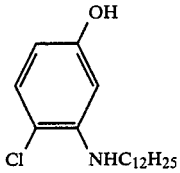

IX-9

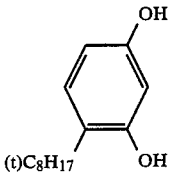

IX-10

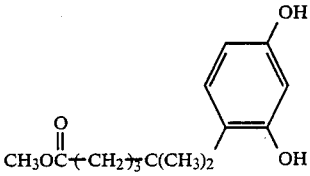

The sensitive material of the present invention can be used as various multilayer silver halide color photosensitive materials such as a color negative film, color reversal film, reversal color paper, color paper, color positive film and large color printing film.

Particularly, the sensitive material of the present invention can be preferably used as the color reversal film, reversal color paper, color paper, color positive film and large color printing film.

The color couplers usable for the silver halide color photographic material of the present invention include, for example, (a) couplers capable of forming a colored dye by the coupling with the oxidation product of the aromatic primary amine, and (b) dye-releasing compounds which release a dye by the redox reaction with an oxidation product of a black-and-white developing agent such as a 3-pyrazolone.

Typical examples of the useful color couplers include naphthol compounds, phenol compounds, pyrazolone compounds, pyrazoloazole compounds and open-chain or heterocyclic ketomethylene compounds. Examples of these cyan, magenta and yellow couplers usable in the present invention are described in patents cited in Research Disclosure (RD), 17643 (December, 1978), Paragraph VII-D and 18717 (November, 1979).

It is preferred that the color coupler contained in the photosensitive material has a ballast group or it is polymerized so that it has a diffusion resistance. A 2-equivalent coupler substituted with a group which can be released by the coupling is preferable to a 4-equivalent coupler in which a hydrogen atom is at the coupling active position, because the former makes smaller the amount of silver to be coated. Further, couplers which provide colored dye having a suitable diffusibility, non-coloring couplers, DIR couplers which release a development inhibitor by the coupling reaction and couplers which release a development accelerator, can also be used.

Typical examples of the yellow couplers usable in the present invention are diffusion-resistant, oil-soluble acylacetamide couplers such as those described in U.S. Pat. Nos. 2,407,210, 2,875,057 and 3,265,506. 2-equivalent yellow couplers are preferably used in the present invention. They include, for example, yellow couplers having an oxygen-linked coupling-off groups as described in U.S. Pat. Nos. 3,408,194, 3,447,928, 3,933,501 and 4,022,620 and yellow couplers having nitrogen-linked coupling-off group as described in Japanese Patent Publication No. 58-10739, U.S. Pat. Nos. 4,401,752 and 4,326,024, RD 18053 (April, 1979), British Pat. No. 1,425,020, West German Patent Public Disclosure Nos. 2,219,917, 2,261,361, 2,329,587 and 2,433,812. α-vivaloylacetanilide couplers are excellent in fastness of the colored dye, particularly light fastness. α-benzoylacetanilide couplers provide a high color density.

Examples of the magenta couplers usable in the present invention include diffusion-resistant, oil-soluble indazolone and cyanoacetyl couplers, preferably 5-pyrazolone and pyrazoloazole couplers such as pyrazolotriazoles. Among the 5-pyrazolone couplers, those having an arylamino group or an acylamino group at position 3 are preferred from the viewpoint of the hue of the colored dye or the color density. Typical examples of them are described in U.S. Pat. Nos. 2,311,082, 2,343,703, 2,600,788, 2,908,573, 3,062,653, 3,152,896 and 3,936,015. As the release groups of the 2-equivalent 5-pyrazolone couplers, nitrogen-linked coupling-off group described in U.S. Pat. No. 4,310,619 and arylthio groups described in U.S. Pat. No. 4,351,897 are particularly preferred. When 5-pyrazolone couplers having a ballast group described in European Pat. No. 73,636 are used, a high color density can be obtained.

The cyan couplers usable in the present invention include diffusion-resistant, oil-soluble naphthol and phenol couplers. Typical examples of them include naphthol couplers described in U.S. Pat. No. 2,474,293, preferably oxygen-linked coupling-off type 2-equivalent naphthol couplers described in U.S. Pat. Nos. 4,052,212, 4,146,396, 4,228,233 and 4,296,200. Examples of the phenol couplers are described in U.S. Pat. Nos. 2,369,929, 2,801,171, 2,772,162 and 2,895,826. The cyan couplers having a high fastness to moisture and temperature are preferably used in the present invention. Typical examples of them include phenolic cyan couplers having an alkyl group having 2 or more carbon atoms such as ethyl group at m-position of the phenol nucleus and described in U.S. Pat. No. 3,772,022; 2,5-diacylamino-substituted phenolic couplers described in U.S. Pat. Nos. 2,771,162, 3,758,308, 4,126,396, 4,334,011 and 4,327,173, West German Patent Public Disclosure No. 3,329,729 and European Pat. No. 121,365; and phenolic couplers having a phenylureido group at position 2 and an acylamino group at position 5 and described in U.S. Pat. Nos. 3,446,622, 4,333,999, 4,451,559 and 4,427,767. Cyan couplers substituted with a sulfonamido group or an amido group at position 5 of naphthol and described in Japanese Patent Application Nos. 59-93605, 59-264277 and 59-268135 provide a fast color image, and therefore preferably usable in the present invention.

It is preferred to use a colored coupler for photographic color negative photosensitive material so as to compensate unnecessary absorption in a short wave region of a dye formed from magenta and cyan couplers. Typical examples of them include yellow-colored magenta couplers described in U.S. Pat. No. 4,163,670 and Japanese Patent Publication No. 57-39413 and magenta-colored cyan couplers described in U.S. Pat. Nos. 4,004,929 and 4,138,258 and British Pat. No. 1,146,368.

Graininess can be improved by using a coupler capable of providing a colored dye having a suitable diffusibility. Examples of such couplers include magenta couplers described in U.S. Pat. No. 4,366,237 and British Pat. No. 2,125,570, and yellow, magenta and cyan couplers described in European Pat. No. 96,570 and West German Patent Public Disclosure No. 3,234,533.

The dye-forming couplers and the above-described special couplers may be in the form of dimers or higher polymers. Typical examples of the polymerized dye-forming couplers are described in U.S. Pat. Nos. 3,451,820 and 4,080,211. Typical examples of the polymerized magenta couplers are described in British Pat. No. 2,102,173, U.S. Pat. No. 4,367,282 and Japanese Patent Application Nos. 60-75041 and 60-113596.

Two or more couplers usable in the present invention can be contained in the same photosensitive layer or the same compound can be introduced into two or more different layers so as to provide the necessary properties of the photosensitive material.

The couplers usable in the present invention can be introduced into the photosensitive material by various known dispersion processes. Typical examples of the processes include solid dispersion process, alkali dispersion process, preferably latex dispersion process and particularly oil-in-water dispersion process. In the oil-in-water dispersion process, the coupler is dissolved in one or a mixture of both of a high-boiling organic solvent having a boiling point of 175° C. or above and a low-boiling assistant solvent, and then the solution is finely dispersed in water or an aqueous medium such as an aqueous gelatin solution. Examples of the high-boiling organic solvents are described in U.S. Pat. No. 2,322,027. The dispersion may be accompanied with a phase inversion and, if necessary, the assistant solvent may be removed or reduced in amount by a distillation, noodle washing or ultrafiltration prior to the application.

The dye-donating compounds usable in the present invention are those capable of forming a diffusing dye or its precursor in an image-shape after the development. For example, color developing agents and non-diffusible couplers releasing a diffusible dye can be used. Preferably, dye-releasing redox compounds (known as DRR compounds) are used. The particularly useful, released dyes are cyan, magenta and yellow dyes.

When two or three couplers selected from the group consisting of the cyan couplers, magenta couplers and yellow couplers are to be contained in a photosensitive emulsion layer or a non-photosensitive layer adjacent thereto, they may be used in the form of emulsified dispersion of a mixture thereof or respective emulsified dispersions therof prepared separately.

The main couplers in two or more silver halide emulsion layers having the same color sensitivity may have different coupling rates.

Particularly when an assistant coupler is added in addition to the main coupler to a color-sensitive layer, the coupling rate of the main coupler in the emulsion layer to which the assistant coupler is added may be different from that in an emulsion layer free of the assistant coupler.

In case the main couplers in two or more emulsion layers have the same color sensitivity have different coupling rates, it is preferred that the coupling rate of the main coupler in the assistant coupler-containing layer is made higher than that of the other so as to prevent the color mixing.

Gelatin is advantageously used as a binder of protective colloid for the emulsion layer or intermediate layer in the photographic material of the present invention. In addition, other hydrophilic colloids can be used singly or as a combination with gelatin.

The photographic emulsion layers in the photographic material of the present invention may contain any of silver halides, i.e. silver bromide, silver bromoiodide, silver chlorobromoiodide, silver chlorobromide and silver chloride. The silver halide useful for the photographic color photosensitive material is silver bromoiodide or silver chlorobromoiodide containing less than about 15 molar % of silver iodide. Particularly preferred is silver bromoiodide containing about 2 to 12 molar % of silver iodide. In the printing color photographic materials, silver bromide, silver chlorobromide and silver chlorobromoiodide are preferred.

The silver halide grains in the photographic emulsion may be in the form of regular crystal such as cubic, octahedral or tetradecahedral an irregular crystal form such as spherical form; those having a crystal defect such as twinning plane; or complexes thereof.

The silver halide grains may be fine grains having a small diameter less than about 0.1$\mu$, or large grains having a diameter of projected surface area up to about 10$\mu$. The emulsion may be of either a monodisperse system having a narrow distribution range, or a polydisperse system having a wide distribution range.

In a typical example of the emulsion of the monodisperse system, the silver halide grains have an average diameter of larger than about 0.1$\mu$ and at least about 95 wt.% of them have a diameter within the average grain diameter $\pm$40%. In the emulsion usable in the present invention, the silver halide grains have an average grain diameter of about 0.25 to 2$\mu$ and at least 95% by weight or by number of the grains have a diameter within the average grain diameter $\pm$20%.

Further, tabular grains having an aspect ratio of at least about 5 can also be used in the present invention. The tabular grains can be prepared easily by processes described in, for example, Gutoff, Photographic Science and Engineering, Vol. 14, 248 to 257 (1970), U.S. Pat. Nos. 4,434,226, 4,414,310, 4,433,048 and 4,439,520 and British Pat. No. 2,112,157. It is described in detail in the above-mentioned U.S. Pat. No. 4,434,226 that when the tabular grains are used, the color sensitization efficiency by the sensitizing dye is improved and also the graininess and sharpness can be improved.

The grains may have a uniform crystal structure or they may be of a core/shell-type in which the halogen composition in the core is different from that of the shell. Further, they may have a laminar structure. These grains are described in British Pat. No. 1,027,146, U.S. Pat. Nos. 3,505,068 and 4,444,877 and Japanese Patent Public Disclosure No. 60-143331. Different silver halides can be bonded together by an epitaxial bond or they can be bonded with a compound other than silver halides such as silver rhodanide or lead oxide. These grains are described in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067 and Japanese Patent Public Disclosure No. 59-162540.

A mixture of the grains having various crystal forms can also be used.

The emulsion of the present invention is usually subjected to the physical ripening, chemical ripening and spectral sensitization before use. The additives to be used in these steps are described in Research Disclosure, Nos. 17643 and 18716 as will be shown in the following table.

Known photographic additives usable in the present invention are also described in the two books of Research Disclosure as shown in the following table.

| Additives | RD 17643 | RD 18716 |
|---|---|---|
| 1 Chemical sensitizer | p. 23 | right column, p. 648 |
| 2 Sensitivity improver | | right column, p. 648 |
| 3 Spectral sensitizer and supersensitizer | pp. 23 to 23 | right column, p. 648 to right column, p. 649 |
| 4 Brightening agent | p. 24 | |
| 5 Antifoggant and stabilizer | pp. 24 to 25 | right column, p. 649 |
| 6 Light absorber, filter dye and U.V. absorber | pp. 25 to 26 | right column, p. 649 to left column, p. 650 |
| 7 Antistaining agent | right column, p. 25 | left and right columns, p. 650 |
| 8 Color image stabilizer | p. 25 | |
| 9 Hardener | p. 26 | left column, p. 651 |
| 10 Binder | p. 26 | left column, p. 651 |
| 11 Plasticizer, lubricant | p. 27 | right column, p. 650 |
| 12 Coating aid, surfactant | pp. 26 to 27 | right column, p. 650 |
| 13 Antistatic agent | p. 27 | right column, p. 650 |

The spectral sensitizer and supersensitizer can be added at any steps, for example, the preparation of the silver halide grains, immediately after the preparation, immediately before the chemical sensitization, during the chemical sensitization, or at the preparation of the coating solution.

The color developer to be used to develop the photosensitive material of the present invention is preferably an alkaline aqueous solution containing an aromatic primary amine color developing agent as the main component. As the color developing agents, aminophenol compounds and particularly preferably p-phenylenediamine compounds are used. Typical examples of them include 3-methyl-4-amino-N,N-diethylaniline, 3-methyl-4-amino-N-ethyl-N-β-hydroxylethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides, phosphates, p-toluenesulfonates, tetraphenylborates and p-(t-octyl)-benzenesulfonates. The diamines in the form of the salts are generally more stable than the free diamines and the former is preferably used.

The aminophenol derivatives include, for example, o-aminophenol, p-aminophenol, 4-amino-2-methylphenol, 2-amino-3-methylphenol and 2-hydroxy-3-amino-1,4-dimethylbenzene.

In addition, the compounds described in L. F. A. Mason, Photographic Processing Chemistry (Focal Press) (1966), pp. 226 to 229, U.S. Pat. Nos. 2,193,015 and 2,592,364 and Japanese Patent Public Disclosure No. 48-64933 can be used. If necessary, a combination of two or more color developing agents can be used.

The color developer can contain pH buffering agents such as alkali metal carbonates, borates and phosphates; development inhibitors or antifoggants such as bromides, iodides, benzimidazoles, benzothiazoles and mercapto compounds; preservatives such as hydroxylamine, triethanolamine, the compounds described in West German Patent Application (OLS) No. 2,622,950, sulfites and bisulfites; organic solvents such as diethylene glycol; development accelerators such as benzyl alcohol, polyethylene glycol, quaternary ammonium salts, amines, thiocyanates, and 3,6-thiaoctane-1,8-diol; dye-forming couplers; competing couplers; nucleating agents such as sodium boron hydride; assistant developing agents such as 1-phenyl-3-pyrazolidone; thickening agents; and chelating agents such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, aminopolycarboxylic acids, e.g. the compounds described in Japanese Patent Public Disclosure No. 58-195845, 1-hydroxyethylidene-1,1'-diphosphonic acid, the organic phosphonic acids described in Research Disclosure 18170 (May, 1979), aminophosphonic acids, e.g. aminotris(methylenephosphonic acid) and ethylenediamine-N,N,N',N'-tetramethylenephosphonic acid, and the phosphonocarboxylic acids described in Japanese Patent Public Disclosure Nos. 52-102726, 53-42730, 54-121127, 55-4024, 55-4025, 55-126241, 55-65955 and 55-65956 and Research Disclosure No. 18170 (May, 1979).

The color developing agent is used in an amount of usually about 0.1 to 30 g, preferably about 1 to 15 g, per liter of the color developer. The pH of the color developer is usually above 7 and mostly about 9 to 13. The quantity of the color developer to be replenished can be reduced by using the replenisher having suitably modified concentrations of the halide and color developing agent.

In the development of the reversal color photosensitive material, the color development is conducted after black-and-white development. The black-and-white developer can contain known black-and-white developing agents such as dihydroxybenzenes, e.g. hydroquinone and hydroquinone monosulfonate; 3-pyrazolidones, e.g. 1-phenyl-3-pyrazolidone; and aminophenols, e.g. N-methyl-p-aminophenol. They can be used either singly or as a combination of two or more of them.

After the color development, the photographic emulsion layer is usually bleached. The bleaching can be conducted simultaneously with fixing in a bleach-fixing bath (blixing bath) or bleaching and fixing can be conducted separately. For conducting the processing rapidly, the bleaching can be followed by bleach-fixing process. Examples of the bleaching agents usable in the bleaching and bleach-fixing step include compounds of polyvalent metals such as iron (III), cobalt (III), chromium (VI) and copper (II), e.g. ferricyanides; peracids; quinones; nitroso compounds; bichromates; organic complex salts of iron (III) and cobalt (III), such as aminopolycarbonates, e.g. ethylenediaminetetraacetates and diethylenetriaminepentaacetates, aminopolyphosphonates, phosphonocarboxylates and organic phosphonates; and organic acids such as citric acid, tartaric acid and malic acid; persulfates; hydrogen peroxide; and permanganates. Among them, the organic complex salts of iron (III) and persulfates are preferred from the viewpoint of environmental pollution.

The aminopolycarboxylic acids, aminopolyphosphonic acids and their salts useful for preparing the organic complex salts of iron (III) are as follows:

ethylenediaminetetraacetic acid,
diethylenetriaminepentaacetic acid,
ethylenediamine-N-(β-hydroxyethyl)-N,N',N'-triacetic acid,
1,2-diaminopropanetetraacetic acid,
triethylenetetraminehexaacetic acid,
propylenediaminetetraacetic acid,
nitrilotriacetic acid,
nitrilotripropionic acid,
cyclohexanediaminetetraacetic acid,
1,3-diamino-2propanoltetraacetic acid,
methyliminodiacetic acid,
iminodiacetic acid,
hydroxyliminodiacetic acid,
dihydroxyethylglycineethyletherdiaminetetraacetic acid,
glycoletherdiaminetetraacetic acid,
ethylenediaminetetrapropionic acid,
ethylenediaminedipropionacetic acid,
phenylenediaminetetraacetic acid,
2-phosphonobutane-1,2,4-triacetic acid,
1,3-diaminopropanol-N,N,N,',N'-tetramethylenephosphonic acid,
ethylenediamine-N,N,N',N'-tetramethylenephosphonic acid,
1,3-propylenediamine-N,N,N',N'-tetramethylenephosphonic acid, and
1-hydroxyethylidene-1,1'-diphosphonic acid.

Among them, iron (III) complex salts of ethylenediaminetetraacetic acid, diethylenetriaminepentaacetic acid, cyclohexanediaminetetraacetic acid, 1,2-diaminopropanetetraacetic acid and methyliminodiacetic acid have a high bleaching power and they are particularly preferred.

Iron (III) complex salts available on the market can be used singly, or iron (III) salts (such as ferric sulfate, ferric chloride, ferric nitrate, ammonium ferric sulfate and ferric phosphate) can be reacted with a chelating agent (such as aminopolycarboxylic acid, aminopolyphosphonic acid or phosphonocarboxylic acid) in the solution to form a ferric ion complex salt. In the latter case, either or both of the ferric salt and chelating agent may be used as a combination of two or more kinds thereof. In both cases, the chelating agent can be used in an amount larger than the stoichiometric amount. The bleaching solution or bleach-fixing solution containing the ferric ion complex can contain also other metal ions such as calcium, magnesium, aluminum, nickel, bismuth, zinc, tungsten, cobalt and copper and their complex salts, or hydrogen peroxide.

The persulfates usable in the bleaching or bleach-fixing process of the present invention include alkali metal persulfates such as potassium persulfate and sodium persulfate, and ammonium persulfate.

The bleaching or bleach-fixing solution can contain a rehalogenating agent such as a bromide (e.g. potassium bromide, sodium bromide or ammonium bromide), a chloride (e.g. potassium chloride, sodium chloride or ammonium chloride) or an iodide (e.g. ammonium iodide). The bleaching or bleach-fixing solution can contain, if necessary, one or more compounds having a pH-buffering action such as inorganic acids, organic acids and their alkali metal or ammonium salts, e.g. boric acid, borax, sodium metaborate, acetic acid, sodium acetate, sodium carbonate, potassium carbonate, phosphorous acid, phosphoric acid, sodium phosphate, citric acid, sodium citrate and tartaric acid; or corrosion inhibitors such as ammonium nitrate and guanidine.

The suitable amount of the bleaching agent is 0.1 to 2 mol per liter of the bleaching solution. The preferred pH range of the bleaching solution is 0.5 to 8.0 for the ferric ion complex salts and 4.0 to 7.0 for the ferric ion complex salts of aminopolycarboxylic acid, aminopolyphosphonic acid, phosphonocarboxylic acid and organic phosphonic acids. The preferred concentration and pH for the persulfate are 0.1 to 2 mol/l and 1 to 5, respectively.

The fixing agents to be used for the fixing or bleach-fixing are known ones, i.e. water-soluble silver halide-dissolving agents, such as thiosulfates, e.g. sodium thiosulfate and ammonium thiosulfate; thiocyanates, e.g. sodium thiocyanate and ammonium thiocyanate; thioethers, e.g. ethylenebisthioglycolic acid and 3,6-dithia-1,8-octanediol; and thioureas. They can be used either singly or as a combination of them. In the bleach-fixing processing, a special bleach-fixing solution comprising a combination of a fixing agent and a large amount of a halide such as potassium iodide, which is described in Japanese Patent Public Disclosure No. 55-155354, can also be used.

In the fixing or bleach-fixing, the desirable concentration of the fixing agent is 0.2 to 4 mol/l. In the bleach-fixing, the concentrations of the ferric ion complex salt and the fixing agent are 0.1 to 2 mol and 0.2 to 4mol, respectively, per liter of the bleach-fixing solution. The pH of the fixing solution or bleach-fixing solution is usually 4.0 to 9.0 and particularly 5.0 to 8.0.

The fixing solution or bleach-fixing solution can contain, in addition to the above-described additives for the bleaching solution, preservatives such as sulfites (e.g. sodium sulfite, potassium sulfite and ammonium sulfite), bisulfites, hydroxylamine, hydrazine and bisulfite adducts of aldehydes (e.g. acetaldehyde/sodium bisulfite). It may contain further various fluorescent brightening agents, antifoaming agents, surfactants and organic solvents such as polyvinylpyrrolidone and methanol.

The bleaching solution, bleach-fixing solution and pre-processing bath may contain, if necessary, a bleaching accelerator. Examples of the useful bleaching accelerators include compounds having a mercapto or disulfido group as described in U.S. Pat. No. 3,893,858, West German Pat. Nos. 1,290,812 and 2,059,988, Japanese Patent Public Disclosure Nos. 53-32736, 53-57831, 53-37418, 53-65732, 53-72623, 53-95630, 53-95631, 53-104232, 53-124424, 53-141623 and 53-28426, and Research Disclosure No. 17129 (June, 1978); thiazoline derivatives described in Japanese Patent Public Disclosure No. 50-140129; thiourea derivatives described in Japanese Patent Publication No. 45-8506, Japanese Patent Public Disclosure Nos. 52-20832 and 53-32735 and U.S. Pat. No. 3,706,561; iodides as described in West German Pat. No. 1,127,715 and Japanese Patent Public Disclosure No. 58-16235; polyethylene oxides as described in West German Pat. Nos. 966,410 and 2,748,430; polyamine compounds as described in Japanese Patent Publication No. 45-8836; compounds as described in Japanese Patent Public Disclosure Nos. 49-42434, 49-59644, 53-94927, 54-35727, 55-26506 and 58-163940; and iodine and bromine ions. Among them, the compounds having a mercapto group or disulfido group are preferred, since they have a remarkable accelerating effect. Particularly, the compounds described in U.S. Pat. No. 3,893,858, West German Pat. No. 1,290,812 and Japanese Patent Public Disclosure No. 53-95630 are preferred. Further, the compounds described in U.S. Pat. No. 4,552,834 are also preferred. These bleaching accelerators can be incorporated in the sensitive material.

After the fixing or bleach-fixing, the material is usually washed with water and stabilized.

In the step of the water washing step and stabilization step, various known compounds can be used in order to prevent the precipitation or to stabilize the washing water. These additives include chelating agents such as inorganic phosphoric acids, aminopolycarboxylic acids and organic phosphonic acids; germicides and antifungal agents for inhibiting bacteria, algae and fungi such as those described in J. Antibact. Antifung. Agents, Vol. 11, No. 5, pp. 207 to 223 (1983) and Hiroshi Horiguchi, 'Bokin Bokabi no Kagaku' (Chemistry for Prevention of Bacteria and Fungi); metal salts such as magnesium, aluminum and bismuth salts; alkali metals and ammonium salts; and surfactants for decreasing drying load and for inhibiting water marks, if necessary. Further, the compounds described in West, Phot. Sci. Eng., Vol. 6, pp. 344 to 359 (1965) can be used as the additives. Particularly, the chelating agents, germicides and antifungal agents are effective.

In the step of the water washing, usually two or more vessels (for example, 2 to 9 vessels) are used to provide a multistage countercurrent washing system so that the washing water is saved. A multistage countercurrent stabilization process as described in Japanese Patent Public Disclosure No. 57-8543 can be conducted in place of the washing with water. The stabilization bath contains, in addition to the above-mentioned additives, various compounds so as to stabilize the image. They include, for example, buffering agents for controlling the pH of the film to, for example, 3 to 9, such as borates, metaborates, borax, phosphates, carbonates, potassium hydroxide, sodium hydroxide, aqueous ammonia, monocarboxylic acids, dicarboxylic acids and polycarboxylic acids which are used as a combination thereof; and aldehydes such as formalin. The stabilization bath can contain other additives such as chelating agents, e.g. inorganic phosphoric acids, aminopolycarboxylic acids, organic phosphonic acids, aminopolyphosphonic acids and phosphonocarboxylic acids; germicides and antifugal agents, e.g. thiazole compounds, isothiazole compounds, halogenated phenols, sulfanylamide and benzotriazole; surfactants; fluorescent brightening agents; and hardeners; metal salts. They can be used either singly or as a combination of two or more of them having the same or different effects.

It is preferable that for improving the image preservation there are used ammonium salts such as ammonium chloride, ammonium nitrate, ammonium sulfate, ammonium phosphate, ammonium sulfite and ammonium thiosulfate as the pH-regulating agent for the film after the above-described steps.

In the processing of the photographic color photosensitive materials, the ordinary steps of water washing and stabilization can be replaced with the above-described, water-saving stabilization step and water washing step. In such a case, formalin can be omitted from the stabilization bath when the magenta coupler is 2-equivalent one.

The time required for the water washing and stabilization according to the present invention is usually 20 sec. to 10 min., preferably 20 sec. to 5 min., although it varies depending on the kind of the photosensitive material and the processing conditions.

The processing solutions are used at a temperature of 10° to 50° C. in the present invention. Although the standard temperature is 33° to 38° C., a higher temperature can be employed so as to accelerate the process or to reduce the processing time. On the other hand, a lower temperature can also be employed so as to improve the image quality and the stability of the processing solution. For saving silver in the photosensitive material, a cobalt intensifier or hydrogen peroxide intensifier can be used as described in West German Pat. No. 2,226,770 and U.S. Pat. No. 3,674,499, or the development, bleaching and fixing can be conducted in the same bath as described in U.S. Pat. No. 3,923,511.

The processing time can be made shorter than the standard one so as to complete the process rapidly so far as no trouble is caused by the time reduction.

To simply and rapidly process the silver halide color photosensitive material, the material can contain a color developing agent or a precursor thereof. The precursor is preferable to the color developing agent, since the former improves the stability of the photosensitive material. Examples of the precursors of the developing agents include the indoaniline compounds described in U.S. Pat. No. 3,342,597; the Schiff bases described in U.S. Pat. No. 3,342,599 and Research Disclosure Nos. 14850 (August, 1976) and 15159 (November, 1976); the aldol compounds described in Research Disclosure, No. 13924; the metal complex salts described in U.S. Pat. No. 3,719,492; the urethane compounds described in Japanese Patent Public Disclosure No. 53-135628; and the salts described in Japanese Patent Public Disclosure Nos. 56-6235, 56-16133, 56-59232, 56-67842, 56-83734, 56-83735, 56-83736, 56-89735, 56-81837, 56-54430, 56-106241, 56-107236, 57-97531 and 57-83565.

The silver halide color photosensitive material of the present invention can contain a 1-phenyl-3-pyrazolidone compound in order to accelerate the color development. The typical 1-phenyl-3-pyrazolidones are described in Japanese Patent Public Disclosure Nos. 56-64339, 57-144547, 57-211147, 58-50532, 58-50536, 58-50533, 58-50534, 58-50535 and 58-115438.

When the processing is conducted continuously, the replenisher for each processing solution is used for inhibiting a change of the composition of the solution in order to obtain an intended finish. The quantity of the replenisher can be reduced to a half or less of the standard quantity so as reduce the cost.

The respective processing baths can contain, if necessary, a heater, temperature sensor, liquid level sensor, circulation pump, filter, floating lid and squeegee.

The photosensitive material of the present invention can be bleach-fixed quite usually when it is a color paper, or if necessary when it is a photographic color photosensitive material.

EXAMPLES

The following examples will further illustrate the present invention, which by no means limit the invention.

EXAMPLE 1

Layers having the following compositions were formed on a primed cellulose triacetate film used as the support, to prepare the following multilayered color photosensitive material (Sample 101):

The first layer (antihalation layer):

A gelatin layer having a dry film thickness of 2μ and containing:

| | |
|---|---|
| Black colloidal silver | 0.25 g/m$^2$ |
| U.V. absorber U-1 | 0.04 g/m$^2$ |
| U.V. absorber U-2 | 0.1 g/m$^2$ |
| U.V. absorber U-3 | 0.1 g/m$^2$ |
| High-boiling organic solvent O-1 | 0.1 cc/m$^2$ |

The second layer (intermediate layer):

A gelatin layer having a dry film thickness of 1μ and containing:

| | |
|---|---|
| Compound H-1 | 0.05 g/m$^2$ |
| High-boiling organic solvent O-2 | 0.05 cc/m$^2$ |

The third layer (the first red-sensitive emulsion layer):

A gelatin layer having a dry film thickness of 1μ and containing:

| | |
|---|---|
| Silver bromoiodide emulsion spectrally sensitized with Sensitizing dyes S-1 and S-2 (iodine content: 4 molar %, average grain size: 0.3μ) | 0.5 g/m$^2$ (silver) |
| Coupler C-1 | 0.2 g/m$^2$ |
| Coupler C-2 | 0.05 g/m$^2$ |
| High-boiling organic solvent O-2 | 0.12 cc/m$^2$ |

The fourth layer (the second red-sensitive emulsion layer):

A gelatin layer having a dry film thickness of 2.5μ and containing:

| | |
|---|---|
| Silver bromoiodide emulsion spectrally sensitized with Sensitizing dyes S-1 and S-2 (iodine content: 2.5 molar %, average grain size: 0.55μ) | 0.8 g/m$^2$ (silver) |
| Coupler C-1 | 0.55 g/m$^2$ |
| Coupler C-2 | 0.14 g/m$^2$ |
| High-boiling organic solvent O-2 | 0.33 cc/m$^2$ |

The fifth layer (intermediate layer):

A gelatin layer having a dry film thickness of 1μ and containing:

| | |
|---|---|
| Compound H-1 | 0.1 g/m$^2$ |
| High-boiling organic solvent O-2 | 0.1 cc/m$^2$ |

The sixth layer (the first green-sensitive emulsion layer):

A gelatin layer having a dry film thickness of 1μ and containing:

| | |
|---|---|
| Silver bromoiodide emulsion spectrally sensitized with sensitizing dyes S-3 and S-4 (iodine content: 3 molar %, average grain size: 0.3μ) | 0.7 g/m$^2$ (silver) |
| Coupler C-3 | 0.35 g/m$^2$ |
| High-boiling organic solvent O-2 | 0.26 cc/m$^2$ |

The seventh layer (the second green-sensitive emulsion layer):

A gelatin layer having a dry film thickness of 2.5μ and containing:

| | |
|---|---|
| Silver bromoiodide emulsion spectrally sensitized with sensitizing dyes S-3 and S-4 (iodine content: 2.5 molar %, average grain size: 0.8μ) | 0.7 g/m$^2$ (silver) |
| Coupler C-4 | 0.25 g/m$^2$ |
| High-boiling organic solvent O-2 | 0.05 cc/m$^2$ |

The eighth layer (intermediate layer):

A gelatin layer having a dry film thickness of 1μ and containing:

| | |
|---|---|
| Compound H-1 | 0.05 g/m$^2$ |
| High-boiling organic solvent O-2 | 0.1 cc/m$^2$ |

The ninth layer (yellow filter layer):

Gelatin layer having a dry film thickness of 1μ and containing:

| | |
|---|---|
| Yellow colloidal silver | 0.1 g/m$^2$ |
| Compound H-1 | 0.02 g/m$^2$ |
| Compound H-2 | 0.03 g/m$^2$ |
| High-boiling organic solvent O-2 | 0.04 cc/m$^2$ |

The tenth layer (the first blue-sensitive emulsion layer):

Gelatin layer having a dry film thickness of 1.5μ and containing:

| | |
|---|---|
| Silver bromoiodide emulsion spectrally sensitized with sensitizing dye S-5 (iodine content: 2.5 molar %, average grain size: 0.7μ) | 0.6 g/m$^2$ (silver) |
| Coupler C-5 | 0.5 g/m$^2$ |
| High-boiling organic solvent O-2 | 0.1 cc/m$^2$ |

The eleventh layer (the second blue-sensitive emulsion layer):

Gelatin layer having a dry film thickness of 3μ and containing:

| | |
|---|---|
| Silver bromoiodide emulsion spectrally sensitized with sensitizing dye S-5 (iodine content: 2.5 molar %, average grain size: 1.2μ) | 1.1 g/m$^2$ (silver) |
| Coupler C-5 | 1.2 g/m$^2$ |
| High-boiling organic solvent O-2 | 0.23 cc/m$^2$ |

The twelfth layer (the first protective layer):

Gelatin layer having a dry film thickness of 2μ and containing:

| | |
|---|---|
| U.V. absorber U-1 | 0.02 g/m$^2$ |
| U.V. absorber U-2 | 0.03 g/m$^2$ |
| U.V. absorber U-3 | 0.03 g/m$^2$ |
| U.V. absorber U-4 | 0.29 g/m$^2$ |
| High-boiling organic solvent O-1 | 0.28 cc/m$^2$ |

The thirteenth layer (the second protective layer):

Gelatin layer having a dry film thickness of 0.8μ and containing:

| | |
|---|---|
| Surface-fogged, fine silver bromoiodide grain emulsion (iodine content: 1 molar %, average grain size: 0.06μ) | 0.1 g/m$^2$ (silver) |
| Polymethyl methacrylate grains (average grain size: 1.5μ) | 0.2 g/m$^2$ |

The respective layers contained Gelatin hardener H-3 and a surfactant in addition to the above-described components.

Preparation of Sample 102:

Sample 102 was prepared in the same manner as in the preparation of Sample 101 except that Couplers C-3 and C-4 in the sixth and seventh layers were replaced by Coupler M-5.

Preparation of Samples 103 and 104:

Samples 103 and 104 were prepared in the same manner as in the preparation of Sample 101 except that Cyan coupler C-6 (having a relative coupling rate to Coupler C-3, RC/RM, of 0.6 and that to Coupler C-5, RC/RY, of 0.6) was incorporated in the seventh layer or the eleventh layer so that the maximum color density provided after the color development would be 0.2.

Preparation of Samples 105 to 109:

Samples 105 to 109 were prepared in the same manner as in the preparation of Sample 102 except that Cyan coupler C-6 (having a relative coupling rate to Coupler M-5, RC/RM, of 0.5) was incorporated in a layer of Sample 102 as indicated in the third column of TABLE 1 so that the maximum color density provided after the color development would be 0.2.

Preparation of Sample 110:

Sample 110 was prepared in the same manner as in the preparation of Sample 102 except that Coupler C-7 (blue-coloring) was incorporated in the seventh layer of Sample 102 so that the maximum color density provided after the color development would be 0.2.

Preparation of Sample 111:

Sample 111 was prepared in the same manner as in the preparation of Sample 102 except that Coupler IX (black coloring) was incorporated in the seventh layer of Sample 102 so that the maximum color density provided after the color development would be 0.2.

Preparation of Sample 112:

Sample 112 was prepared in the same manner as in the preparation of Sample 102 except that Coupler M-5 in the seventh layer was replaced by Coupler C-3.

Pictures of a bright red object having delicate shades were taken by using Samples 101 to 112 and the development was conducted as follows:

Processing steps:

| Step | Time | Temperature |
|---|---|---|
| The first development | 6 min. | 38° C. |
| Washing with water | 2 min. | " |
| Reversal | 2 min. | " |
| Color development | 6 min. | " |
| Compensation | 2 min. | " |
| Bleaching | 6 min. | " |
| Fixing | 4 min. | " |
| Washing with water | 4 min. | " |
| Stabilization | 1 min. | ambient temp. |
| Drying | | |

The processing solutions used herein had the following compositions:

The first developer:

| | |
|---|---|
| water | 700 ml |
| pentasodium nitrilo-N,N,N—trimethylenephosphonate | 3 g |
| sodium sulfite | 20 g |
| hydroquinone monosulfonate | 30 g |
| sodium carbonate monohydrate | 30 g |
| 1-phenyl-4-methyl-4-hydroxymethyl-3-pyrazolidone | 2 g |
| potassium bromide | 2.5 g |
| potassium thiocyanate | 1.2 g |
| potassium iodide (0.1% solution) | 2 ml |
| water | ad 1000 ml |

Reversal solution:

| | |
|---|---|
| water | 700 ml |
| pentasodium nitrilo-N,N,N—trimethylene phosphonate | 3 g |
| stannous chloride (dihydrate) | 1 g |
| p-aminophenol | 0.1 g |
| sodium hydroxide | 8 g |
| glacial acetic acid | 15 ml |
| water | ad 1000 ml |

Color developer:

| | |
|---|---|
| water | 700 ml |
| pentasodium nitrilo-N,N,N—trimethylenephosphonate | 3 g |
| sodium sulfite | 7 g |
| sodium tertiary phosphate (12 hydrate) | 36 g |
| potassium bromide | 1 g |
| potassium iodide (0.1% solution) | 90 ml |
| sodium hydroxide | 3 g |
| citrazinic acid | 1.5 g |
| N—ethyl-N—(β-methanesulfonamidoethyl)-3-methyl-4-aminoaniline sulfate | 11 g |
| ethylenediamine | 3 g |
| water | ad 1000 ml |

Compensating solution:

| | |
|---|---|
| water | 700 ml |
| sodium sulfite | 12 g |
| sodium ethylenediaminetetraacetate (dihydrate) | 8 g |
| thioglycerol | 0.4 ml |
| glacial acetic acid | 3 ml |
| water | ad 1000 ml |

Bleaching solution:

| | |
|---|---|
| water | 800 ml |
| sodium ethylenediaminetetraacetate (dihydrate) | 2 g |
| ammonium iron (III) ethylenediamine-tetraacetate (dihydrate) | 120 g |
| potassium bromide | 100 g |
| water | ad 1000 ml |

Fixing solution:

| | |
|---|---|
| water | 800 ml |
| sodium thiosulfate | 80.0 g |
| sodium sulfite | 5.0 g |
| sodium bisulfite | 5.0 g |
| water | ad 1000 ml |

Stabilizing solution:

| | |
|---|---|
| water | 800 ml |
| formalin (37 wt. %) | 5.0 g |
| Fuji Driwel (surfactant of Fuji Film Co., Ltd.) | 5.0 ml |
| water | ad 1000 ml |

The results are shown in Table 1.

TABLE 1

| Sample | Coupler in the sixth layer (green-sensitive layer) | Cyan gradation-added layer | Color density of magenta or yellow coloring region wherein the cyan gradation is added | Color hue of the coupler for addition of cyan gradation | Saturation | Shadow representation |
|---|---|---|---|---|---|---|
| 101 (comparative) | C-3 | — | — | — | X | Δ |
| 102 (comparative) | M-5 | — | — | — | ◎ | X |
| 103 (comparative) | C-3 | The seventh layer | 1.2 | Cyan | XX | ○ |
| 104 (comparative) | M-5 | The eleventh layer | 0.5 | " | X | ○ |
| 105 (comparative) | M-5 | The sixth layer | 0.6 | " | Δ | ○ |
| 106 | M-5 | The seventh layer | 1.2 | " | ◎ | ○ |
| 107 | M-5 | The eleventh layer | 1.0 | " | ○ | ○ |
| 108 | M-5 | The eighth layer | 1.3 | " | ◎ | ○ |
| 109 | M-5 | The twelfth layer | 1.1 | " | ○ | ○ |
| 110 | M-5 | The seventh layer | 1.3 | Blue | ◎ | ○ |
| 111 | M-5 | The seventh layer | 1.3 | Black | ◎ | ○ |
| 112 | M-5 | The seventh layer | 1.0 | Magenta | ○ | Δ |

It is apparent from Table 1 that the samples of the present invention were superior to the comparative samples in both saturation and shade representation.

*Note:
◎: Excellent,
○: Good,
Δ: Fair,
X: Poor,
XX: Bad

The compounds used in the preparation of the samples were as follows:

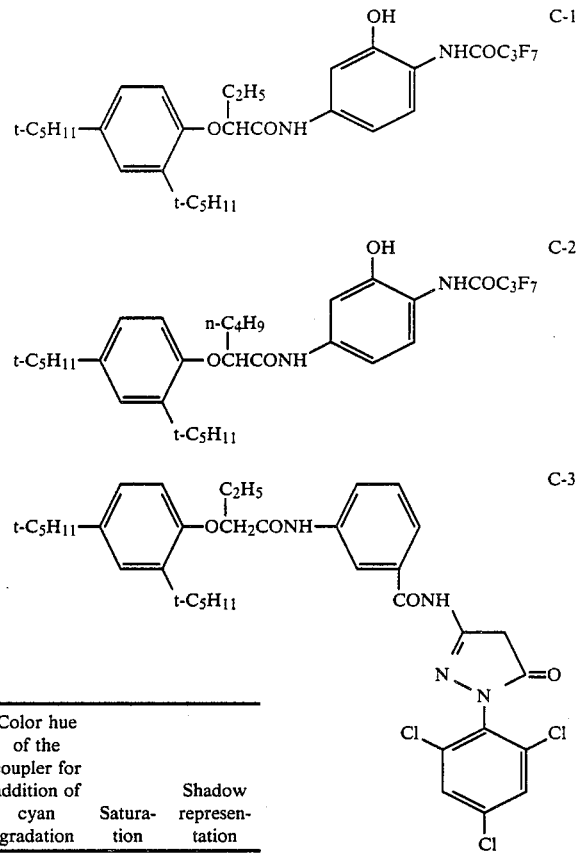

-continued
C-4
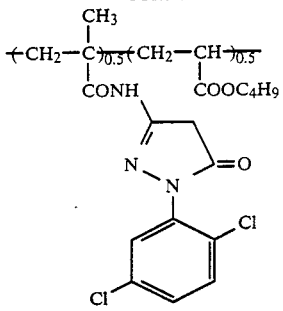
C-5
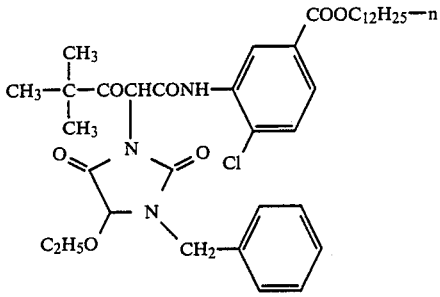
C-6
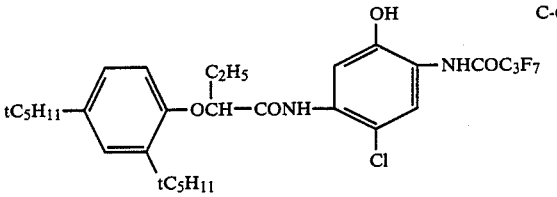
C-7
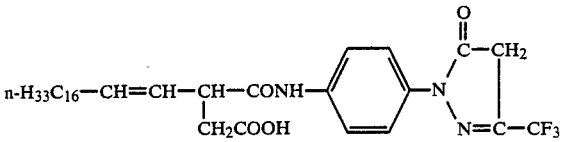
U-1
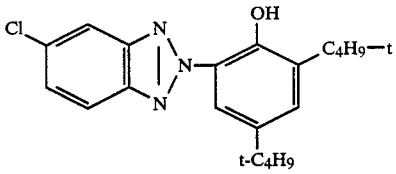
U-2
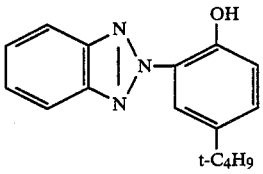
U-3
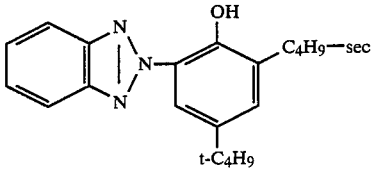
U-4
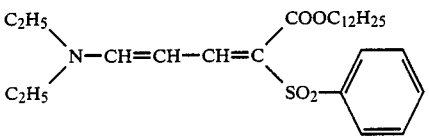
-continued
H-1
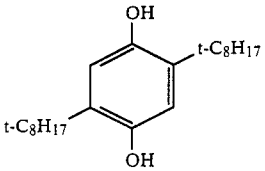
H-2
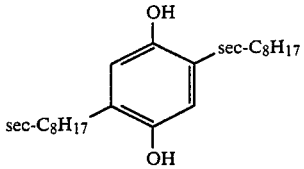
H-3
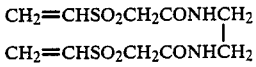
O-1
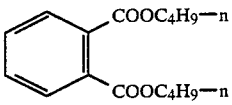
O-2
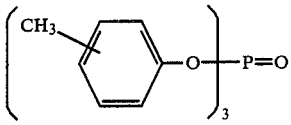
S-1
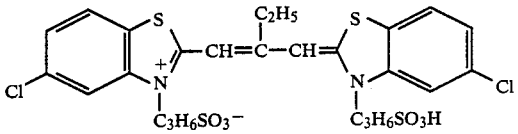
S-2
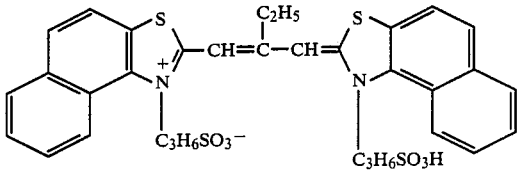
S-3
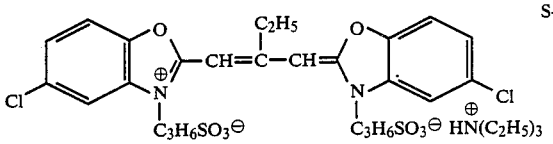
S-4
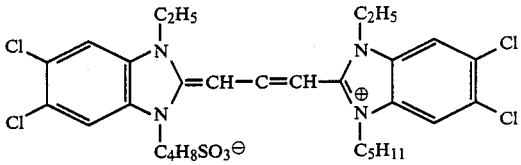
S-5
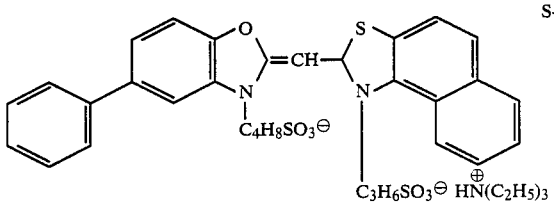

EXAMPLE 2

On a paper support both surfaces of which were laminated with polyethylene, the following layers from the first layer (the lower most layer) to the eleventh layer were coated, to produce a multilayered color photosensitive material (Sample 201). (The unit mg/m$^2$ means the amount of the coating.)

| | | |
|---|---|---|
| The eleventh layer (protective layer) | gelatin | 1000 mg/m$^2$ |
| | silver chlorobromide emulsion (silver bromide content: 2.0 molar %, average grain size: 0.2μ) | silver 10 mg/m$^2$ |
| The tenth layer (U.V. absorbing layer) | gelatin | 1500 mg/m$^2$ |
| | U.V. absorber (*1) | 1000 mg/m$^2$ |
| | solvent for U.V. absorber (*2) | 300 mg/m$^2$ |
| | color-mixing inhibitor (*3) | 80 mg/m$^2$ |
| The ninth layer (high-speed blue-sensitive layer) | silver bromoiodide emulsion (silver iodide content: 2.5 molar %, average grain size: 1.0μ) | silver 200 mg/m$^2$ |
| | blue sensitizing dye (*4) | |
| | gelatin | 1000 mg/m$^2$ |
| | yellow coupler (*5) | 400 mg/m$^2$ |
| | solvent for coupler (*2) | 100 mg/m$^2$ |
| The eighth layer (low-speed blue-sensitive layer) | silver bromoiodide emulsion silver iodide content: 2.5 molar %, average grain size: 0.5μ) | silver 150 mg/m$^2$ |
| | blue sensitizing dye (*4) | |
| | gelatin | 500 mg/m$^2$ |
| | yellow coupler (*5) | 200 mg/m$^2$ |
| | solvent for coupler (*2) | 50 mg/m$^2$ |
| The seventh layer (yellow filter layer) | yellow colloidal silver | 200 mg/m$^2$ |
| | gelatin | 1000 mg/m$^2$ |
| | color mixing inhibitor (*6) | 60 mg/m$^2$ |
| | solvent for color mixing inhibitor (*7) | 240 mg/m$^2$ |
| The sixth layer (high-speed green-sensitive layer) | silver bromoiodide emulsion (silver iodide content: 3.5 molar %, average grain size: 0.9μ) green-sensitive, sensitizing dye (*8) | silver 200 mg/m$^2$ |
| | gelatin | 700 mg/m$^2$ |
| | magenta coupler (*9) | 150 mg/m$^2$ |
| | decoloration inhibitor A (*10) | 50 mg/m$^2$ |
| | decoloration inhibitor B (*11) | 50 mg/m$^2$ |
| | decoloration inhibitor C (*12) | 20 mg/m$^2$ |
| | solvent for coupler (*13) | 150 mg/m$^2$ |
| The fifth layer (low-speed green-sensitive layer) | silver bromoiodide emulsion (silver iodide content: 2.5 molar %, average grain size: 0.4μ) the same green-sensitive sensitizing dye, gelatin, magenta coupler, decoloration inhibitor and solvent for coupler as in the sixth layer | silver 200 mg/m$^2$ |
| The fourth layer (intermediate layer) | yellow colloidal silver | 20 mg/m$^2$ |
| | gelatin | 1000 mg/m$^2$ |
| | color mixing inhibitor (*6) | 80 mg/m$^2$ |
| | solvent for color mixing inhibitor (*7) | 160 mg/m$^2$ |
| | polymer latex | 400 mg/m$^2$ |
| The third layer (high-speed red-sensitive layer) | silver bromoiodide emulsion (silver iodide content: 8.0 molar %, average grain size: 0.7μ) red sensitizing dye (*15, 16) | silver 100 mg/m$^2$ |

-continued

| | | |
|---|---|---|
| | gelatin | 500 mg/m$^2$ |
| | cyan coupler (*17) | 100 mg/m$^2$ |
| | decoloration inhibitor (*18) | 50 mg/m$^2$ |
| | solvent for coupler (*5, 19) | 20 mg/m$^2$ |
| The second layer (low-speed red-sensitive layer) | silver bromoiodide emulsion (silver iodide content: 3.5 molar %, average grain size: 0.35μ) red sensitizing dye (*15, 16) | silver 150 mg/m$^2$ |
| | gelatin | 1000 mg/m$^2$ |
| | cyan coupler (*17) | 300 mg/m$^2$ |
| | decoloration inhibitor (*18) | 150 mg/m$^2$ |
| | solvent for coupler (*5, 19) | 60 mg/m$^2$ |
| The first layer (halation-inhibiting layer) | black colloidal silver | 100 mg/m$^2$ |
| | gelatin | 2000 mg/m$^2$ |
| Support | paper laminated with polyethylene (containing a white pigment such as $TiO_2$ and a blue dye such as ultramarine in the polyethylene layer adjacent to the first layer) | |

*1 5-chloro-2-(2-hydroxy-3-t-butyl-5-t-octyl) phenylbenztriazole,
*2 trinonyl phosphate,
*3 2,5-di-sec-octylhydroquinone,
*4 triethylammonium 3-[2-(3-benzylrhodanin-5-ylidene)-3-benzoxazolinyl]propane sulfonate
*5 Y-11<α-pivaloyl-α-[2,4-dioxo-1-benzyl-5-ethoxyhydantoin-3-yl)-2-chloro-5-[α-2,4-di-t-amylphenoxy)butaneamido]acetanilide>
*6 2,5-di-t-octylhydroquinone,
*7 o-cresyl phosphate,
*8 sodium 5,5-diphenyl-9-ethyl-3,3-disulfopropyloxacarbocyanine
*9 M-1<1-(2,4,6-trichlorophenyl)-3-[2-chloro-5-tetradecaneamido]anilino-2-pyrazolin-5-one>,
*10 3,3,3',3'-tetramethyl-5,6,5',6'-tetrapropoxy-1,1'-bis-spiroindane
*11 di-[2-hydroxy-3-t-butyl-5-methylphenyl]methane
*12 2,5-di-t-hexylhydroquinone
*13 trioctyl phosphate
*14 polyethyl acrylate
*15 triethylammonium 3-[2{2-[3-(3-sulfonatopropyl)naphtho[1,2-α]thiazolin-2-ylidenemethyl]-1-butenyl}-3-naphtho[1,2-α]thiazolino]propane sulfonate,
*16 sodium 5,5'-dichloro-3,3'-di(3-sulfobutyl)-9-ethylthiacarbocyanine,
*17 c-13<2-[α(2,4-di-t-amylphenoxy)butaneamido]-4,6-dichloro-5-methylphenol>,
*18 2-(2-hydroxy-3-sec-butyl-5-t-butylphenyl)benzotriazole, and
*19 dioctyl phthalate.

Preparation of Sample 202:

Sample 202 was prepared in the same manner as in the preparation of Sample 201 except that Magenta coupler *9 in the fifth layer and the sixth layer was replaced by Coupler M-5.

Preparation of Sample 203:

Sample 203 was prepared in the same manner as in the preparation of Sample 201 except that Cyan coupler C-6 (having a relative coupling rate to Magenta coupler *9, RC/RM, of 0.6) was incorporated in the sixth layer so that the maximum color density provided after the color development would be 0.15.

Preparation of Sample 204:

Sample 204 was prepared in the same manner as in the preparation of Sample 202 except that Cyan coupler C-6 was incorporated in the fifth layer so that the maximum color density provided after the color development would be 0.15.

Preparation of Sample 205:

Sample 205 was prepared in the same manner as in the preparation of Sample 202 except that Cyan coupler *17 (having a relative coupling rate to Magenta coupler *9, RC/RM, of 1.0) was incorporated in the sixth layer so that the maximum color density provided after the color development would be 0.15.

Preparation of Sample 206:

Sample 206 was prepared in the same manner as in the preparation of Sample 205 except that Cyan coupler *17 in the sixth layer was replaced by Coupler C-6.

Preparation of Sample 207:

Sample 207 was prepared in the same manner as in the preparation of Sample 202 except that a layer having the same composition as that of the ninth layer but containing Cyan coupler C-6 in place of the yellow coupler *5 was provided between the ninth layer and the tenth layer so that the maximum color density of the cyan component provided after the color development would be 0.15.

Preparation of Sample 208:

Sample 208 was prepared in the same manner as in the preparation of Sample 202 except that a layer having the same composition as that of the sixth layer but containing Cyan coupler C-6 in place of Magenta coupler *9 was provided between the sixth layer and the seventh layer so that the maximum color density of the cyan component provided after the color development would be 0.15.

Preparation of Sample 209:

Sample 209 was prepared in the same manner as in the preparation of Sample 202 except that a layer having the same composition as that of the sixth layer but containing black Coupler IX-1 in place of Magenta coupler *9 was provided between the sixth layer and the seventh layer so that the maximum color density of the cyan component provided after the color development would be 0.15.

Preparation of Sample 210:

Sample 210 was prepared in the same manner as in the preparation of Sample 202 except that a layer having the same composition as that of the sixth layer but containing Coupler C-7 (blue) in place of Magenta coupler *9 was provided between the sixth layer and the seventh layer so that the maximum color density of the cyan component provided after the color development would be 0.15.

By using Samples 201 to 210, the printing exposure was conducted with a color reversal film having bright red image and delicate shades as the original, and then the development was conducted as follows:

Processing steps:

| | | |
|---|---|---|
| The first development (black-and-white development) | 38° C. | 1'15" |
| Washing with water | 38° C. | 2'15" |
| Reversal exposure | at least 100 Lux | |
| Color development | 38° C. | 1'30" |
| Washing with water | 38° C. | 45" |

-continued

| | | |
|---|---|---|
| Bleach-fixing | 38° C. | 2' |
| Washing with water | 38° C. | 2'15" |
| | Total 10' | |

(Compositions of Processing Solutions)

The first developer (black-and-white developer):

| | |
|---|---|
| disodium ethylenediaminetetraacetate (dihydrate) | 3.0 g |
| sodium hydrogencarbonate | 2.3 g |
| 1-phenyl-3-pyrazolidone | 0.45 g |
| anhydrous potassium sulfite | 47 g |
| hydroquinone | 6 g |
| potassium carbonate | 25 g |
| sodium bromide | 1.4 g |
| potassium iodide (0.1%) | 3 ml |
| diethylene glycol | 20.0 ml |
| potassium thiocyanate | 1.0 g |
| water | ad 1 l |
| pH adjusted to 10.2 with sodium hydroxide | |

Color developer:

| | |
|---|---|
| benzyl alcohol | 12 ml |
| pentasodium nitrilo-N,N,N—trimethylenephosphonate | 3.0 g |
| anhydrous sodium sulfite | 7.5 g |
| potassium carbonate | 32.0 g |
| potassium bromide | 0.3 g |
| potassium iodide (0.1%) | 90.0 ml |
| sodium hydroxide | 2.3 g |
| N—ethyl-N—(β-methanesulfonamidoethyl)-3-methyl-4-aminoaniline sulfate | 11.0 g |
| ethylene glycol | 20 ml |
| ethylenediamine | 3 g |
| water | ad 1 l (pH: 10.75) |

Bleach-fixing solution:

| | |
|---|---|
| 5-amino-2-mercapto-1,3,4-thiadiazole | 1.0 g |
| ammonium bromide | 50.0 g |
| aqueous ammonia (28%) | 30.0 ml |
| ammonium iron (III) ethylenediaminetetraacetate monohydrate | 45 g |
| disodium ethylenediaminetetraacetate dihydrate | 2 g |
| anhydrous sodium sulfite | 10 g |
| ammonium thiosulfate | 160.0 ml |
| glacial acetic acid | 5.9 ml |
| water | ad 1 l (pH: 6.7) |

TABLE 2

| Sample | Coupler in the sixth layer (green-sensitive layer) | Cyan gradation-added layer | Color density of magenta or yellow coloring region wherein the cyan gradation is added | Color hue of the coupler for addition of cyan gradation | Saturation | Shadow representation |
|---|---|---|---|---|---|---|
| 201 (comparative) | *9 | — | — | — | X | Δ |
| 202 (comparative) | M-5 | — | — | — | ◎ | X |
| 203 (comparative) | *9 | The sixth layer | 1.0 | Cyan | XX | ○ |
| 204 (comparative) | M-5 | The fifth layer | 0.6 | " | X | ○ |
| 205 | M-5 | The sixth layer | 0.75 | " | ○ | ○ |
| 206 | M-5 | The sixth layer | 1.2 | " | ◎ | ○ |
| 207 | M-5 | Between the | 1.2 | " | ○ | ○ |

TABLE 2-continued

| Sample | Coupler in the sixth layer (green-sensitive layer) | Cyan gradation-added layer | Color density of magenta or yellow coloring region wherein the cyan gradation is added | Color hue of the coupler for addition of cyan gradation | Saturation | Shadow representation |
|---|---|---|---|---|---|---|
| | | tenth layer and the ninth layer | | | | |
| 208 | M-5 | Between the sixth layer and the seventh layer | 1.2 | " | ◎ | ○ |
| 209 | M-5 | Between the sixth layer and the seventh layer | 1.2 | Black | ◎ | ○ |
| 210 | M-5 | Between the sixth layer and the seventh layer | 1.2 | Blue | ◎ | ○ |

It is apparent from Table 2 that the samples of the present invention were superior to the comparative samples in both saturation and shade representation.

EXAMPLE 3

Sample 301 was prepared by successively forming the first layer (the bottom layer) to the eighth layer (the top layer) on a support both surfaces of which had been laminated with polyethylene:

| | |
|---|---|
| **The first layer (blue-sensitive emulsion layer):** | |
| Silver chlorobromide emulsion (silver bromide content: 80 molar %; 0.6μ) | mg/m$^2$ |
| Yellow coupler (*25) | mg/m$^2$ |
| Solvent for coupler (*26) | mg/m$^2$ |
| Gelatin | mg/m$^2$ |
| **The second layer (intermediate layer):** | |
| Gelatin | 1000 mg/m$^2$ |
| **The third layer (the first green-sensitive emulsion layer):** | |
| Silver chlorobromide emulsion (silver bromide content: 70 molar %; 0.4μ) | 100 mg/m$^2$ (silver) |
| Sensitizing dye (*28) | 0.25 mg/m$^2$ |
| Magenta coupler (*23) | 65 mg/m$^2$ |
| Solvent for coupler (*24) | 40 mg/m$^2$ |
| Gelatin | 215 mg/m$^2$ |
| **The fourth layer (the second green-sensitive emulsion layer):** | |
| Silver chlorobromide emulsion (silver bromide content: 70 molar %; 0.5μ) | 100 mg/m$^2$ (silver) |
| Sensitizing dye (*28) | 0.25 mg/m$^2$ |
| Magenta coupler (*23) | 65 mg/m$^2$ |
| Solvent for coupler (*24) | 40 mg/m$^2$ |
| Gelatin | 215 mg/m$^2$ |
| **The fifth layer (intermediate layer):** | |
| U.V. absorber (*20) | 600 mg/m$^2$ |
| Solvent for U.V. absorber (*21) | 300 mg/m$^2$ |
| Gelatin | 800 mg/m$^2$ |
| **The sixth layer (intermediate layer):** | |
| Gelatin | 500 mg/m$^2$ |
| **The seventh layer (red-sensitive emulsion layer):** | |
| Silver chlorobromide emulsion (silver bromide content: 50 molar %, 0.4μ) | 300 mg/m$^2$ |
| Sensitizing dye (*27) | 0.04 mg/m$^2$ |
| Cyan coupler (*22) | 400 mg/m$^2$ |
| Solvent for coupler (*21) | 400 mg/m$^2$ |
| Gelatin | 1000 mg/m$^2$ |
| **The eighth layer (U.V. absorbing layer):** | |
| U.V. absorber (*20) | 600 mg/m$^2$ |
| Solvent for U.V. absorber (*21) | 300 mg/m$^2$ |
| Gelatin | 800 mg/m$^2$ |
| **The ninth layer (protective layer):** | |
| Gelatin | 1000 mg/m$^2$ |

The respective layers contained Gelatin hardener H-3 and a surfactant in addition to the above-described components.

(*20) U.V. absorber: 2-(2-hydroxy-3-sec-butyl-5-tert-butylphenyl)benzotriazole

-continued (*21) Solvent: dibutyl phthalate (*22) Coupler: 2-[α-(2,4-di-tert-pentylphenoxy) butaneamido]-4,6-dichloro-5-ethylphenol (*23) Coupler: 1-(2,4,6-trichlorophenyl)-3-(2-chloro-5-tetradecaneamido)anilino-4-(2-butoxy-5-tert-octylphenylthio)-2-pyrazolin-5-one (*24) Solvent: tricresyl phosphate (*25) Coupler: α-pivaloyl-α-(2,4-dioxy-5,5'-dimethyl-oxazolidin-3-yl)-2-chloro-5-[α-(2,4-di-tert-pentyloxy)butaneamido] acetanilide (*26) Solvent: dioctylbutyl phosphate.

(*27) Spectral sensitizing dye

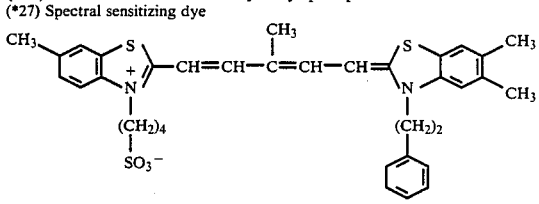

(*28) Spectral sensitizing dye

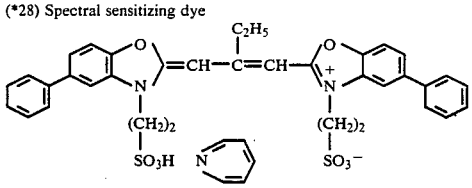

(*29)

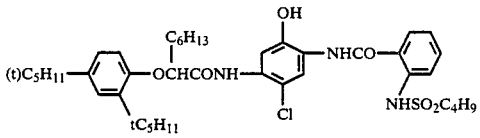

Preparation of Samples 302 to 304:

Samples 302 to 304 were prepared in the same manner as in the preparation of Sample 301 except that Magenta coupler *23 in the third layer and the fourth layer was replaced by Couplers M-5, M-36 and M-37, respectively.

Preparation of Sample 305:

Sample 305 was prepared in the same manner as in the preparation of Sample 301 exept that Cyan coupler *29 (having a relative coupling rate to coupler. *23, $R_{(*29)}/R_{(*23)}$, of 0.6) was incorporated in the third layer so that the maximum color density provided after the color development would be 0.15.

Preparation of Sample 306:

Sample 306 was prepared in the same manner as in the preparation of Sample 303 except that Cyan coupler *29 (having a relative coupling rate to Coupler M-36, $R_{(*29)}/R_{(M\text{-}36)}$, of 0.6) was incorporated in the fourth layer so that the maximum color density provided after the color development would be 0.15.

Preparation of Sample 307:

Sample 307 was prepared in the same manner as in the preparation of Sample 303 except that Cyan coupler *22 (having a relative coupling rate to Coupler M-36, i.e. $R_{(*22)}/R_{(M\text{-}36)}$, of 0.8) was incorporated in the third layer so that the maximum color density provided after the color development would be 0.15.

Preparation of Samples 308 to 310:

Samples 308, 309 and 310 were prepared in the same manner as in the preparation of Samples 303, 302 and 304, respectively, except that Cyan coupler *29 (having relative coupling rates to Coupler M-5 and M-37, i.e. $R_{(*29)}/R_{(M\text{-}5)}$ and $R_{(*29)}/R_{(M\text{-}37)}$, of 0.61 and 0.58, respectively) was incorporated in the third layer so that the maximum color density provided after the color development would be 0.15..

Pictures of an object were taken to form color negative films having a bright red color with delicate shades. After the printing with Samples 301 to 310, the development was conducted as follows.

The results are shown in Table 3.

Processing steps. (33° C.):

| | | |
|---|---|---|
| Color development | 3 min. | 30 sec. |
| Bleach-fixing | 1 min. | 30 sec. |
| Washing-with-water | 3 min | |
| Drying | 10 min. | |

The processing solutions used herein had the following compositions:

Color developer:

| | |
|---|---|
| benzyl alcohol | 15 ml |
| diethylene glycol | 5 ml |
| potassium carbonate | 25 g |

-continued

| | |
|---|---|
| sodium chloride | 0.1 g |
| sodium bromide | 0.5 g |
| anhydrous sodium sulfite | 2 g |
| hydroxylamine sulfate | 2 g |
| N—ethyl-N—β-methanesulfonamidoethyl-3-methyl-4-aminoaniline sulfate | 4 g |
| water | ad 1000 l |
| pH adjusted to 10 with NaOH | |

Bleach-fixing solution:

| | |
|---|---|
| ammonium thiosulfate | 124.5 g |
| sodium metabisulfite | 13.3 g |
| anhydrous sodium sulfite | 2.7 g |
| ammonium ferric EDTA | 65 g |
| water | ad 1000 g |
| pH adjusted to 6.8 | |

TABLE 3

| Sample | Coupler in the layer (green-sensitive layer) | Cyan gradation-added layer | Color density of magenta or yellow coloring region wherein the cyan gradation is added | Color hue of the coupler for addition of cyan gradation | Saturation | Shadow representation |
|---|---|---|---|---|---|---|
| 301 (comparative) | *23 | — | — | — | X | Δ |
| 302 (comparative) | M-5 | — | — | — | ◎ | X |
| 303 (comparative) | M-36 | — | — | — | ◎ | X |
| 304 (comparative) | M-37 | — | — | — | ◎ | X |
| 305 (comparative) | *23 | The third layer | 1.2 | Cyan | XX | ○ |
| 306 (comparative) | M-36 | The fourth layer | 0.6 | " | X | ○ |
| 307 | M-36 | The third layer | 0.7 | " | ○ | ○ |
| 308 | M-36 | The third layer | 1.2 | " | ◎ | ○ |
| 309 | M-5 | The third layer | 1.2 | " | ◎ | ○ |
| 310 | M-37 | The third layer | 1.2 | " | ◎ | ○ |

It is apparent from Table 3 that the samples of the present invention were superior to the comparative samples in both saturation and shade representation.

What is claimed is:

1. A silver halide color photosensitive material comprising, on a support, at least one cyan coloring red-sensitive silver halide emulsion layer, at least one magenta coloring green-sensitive silver halide emulsion layer and at least one yellow coloring blue-sensitive silver halide emulsion layer, characterized in that at least one coupler represented by the formula (I) is contained in at least one green-sensitive emulsion layer, and a cyan gradation is added to a specific image of a region in which yellow and/or magenta image density obtained by color development exceeds 0.7, so as to increase cyan image gradation in the specific image region independently of the cyan density in the cyan coloring red-sensitive layer and as the yellow and/or magenta image density in the specific image region increases:

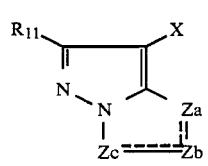

(I)

wherein $R_{11}$ represents a hydrogen atom or a substituent, X represents a hydrogen atom or a group which can be released upon a coupling reaction with an oxidized product of an aromatic primary amine developing agent, and Za, Zb and Zc each represents a machine, substituted methine, =N— or —NH— group; one of the Za—Zb bond and Zb—Zc bond is a double bond and the other is a single bond; when Zb—Zc is a carbon-to-carbon double bond, it may compose a part of a condensed aromatic bond; $R_{11}$ or X may form a higher polymer including a dimer or more; and when Za, Zb or Zc is the substituted methine, a higher polymer including a dimer or more may be formed through the substituted methine.

2. The photosensitive material of claim 1, wherein said coupler is selected from the group consisting of the couplers having the following general formulae (II) to (VIII):

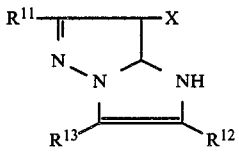
(II)

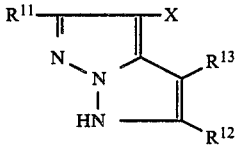
(III)

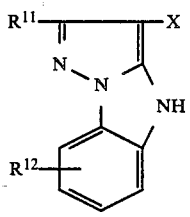
(IV)

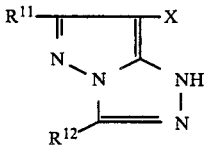
(V)

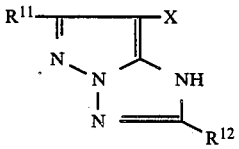
(VI)

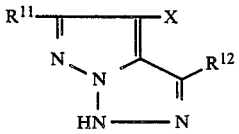
(VII)

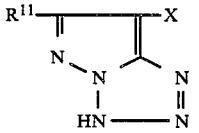
(VIII)

wherein $R^{11}$, $R^{12}$ and $R^{13}$ may be the same or different and each represents a hydrogen atom, a halogen atom or an alkyl, aryl, heterocyclic, cyano, alkoxy, aryloxy, heterocyclic oxy, acyloxy, carbamoyloxy, silyloxy, sulfonyloxy, acylamino, anilino, ureido, imido, sulfamoylamino, carbamoylamino, alkylthio, arylthio, heterocyclic thio, alkoxycarbonylamino, aryloxycarbonylamino, sulfonamido, carbamoyl, acyl, sulfamoyl, sulfonyl, sulfinyl, alkoxycarbonyl or aryloxycarbonyl group, and X represents a hydrogen atom, a halogen atom, a carboxy group or a group capable of bonding with a carbon atom at the coupling position through an oxygen atom, nitrogen atom or sulfur atom and of being released by the coupling, or $R^{11}$, $R^{12}$, $R^{13}$ or X may be a divalent group to form a bis-compound.

3. The photosensitive material of claim 1, wherein said coupler is used in an amount of $5\times10^{-2}$ to $5\times10^{-1}$ mole per 1 mole of the silver contained in the same emulsion layer as that containing said coupler.

4. The photosensitive material of claim 1, wherein said density region is such that the yellow and/or magenta image density exceeds 1.0.

5. The photosensitive material of claim 4, wherein said density region is such that the yellow and/or magenta image density exceeds 1.2.

6. The photosensitive material of claim 1, wherein the maximum density of said cyan degradation to be added is 0.05 to 0.50.

7. The photosensitive material of claim 6, wherein said maximum density is 0.10 to 0.40.

8. The photosensitive material of claim 1, comprising a cyan, blue, magenta, or black coloring coupler in a green-sensitive layer, a blue-sensitive layer or a nonphotosensitive layer, thereby producing cyan gradation.

9. The photosensitive material of claim 8, wherein said blue coloring coupler has an absorption maximum at 570 to 649 nm.

10. The photosensitive material of claim 8, wherein said black coloring coupler is a compound having the general formula (IX):

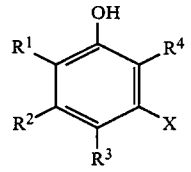

wherein X represents a hydroxyl group or

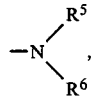

$R_1$ and $R^3$ each represents a hydrogen atom, a substituted or unsubstituted alkyl, acyl, sulfonyl, amido, carbamoyl, ureido, sulfonamido, alkoxycarbonyl or aryloxycarbonyl group, or a group which can be released by the coupling reaction with the aromatic primary amine developing agent, $R^2$ and $R^4$ each represents a hydrogen atom, a halogen atom or a substituted or unsubstituted alkyl, alkoxy, alkylthio, acyl, sulfonyl, amido, carbamoyl, ureido, sulfonamido, alkoxycarbonyl or aryloxycarbonyl group, and $R^5$ and $R^6$ each represents a hydrogen atom or a substituted or unsubstituted alkyl, aryl, alkenyl or heterocyclic group, the total carbon number of $R^1$ to $R^6$ being at least 8 and at least one of $R^1$ and $R^3$ being a hydrogen atom or a group which can be released by the coupling reaction with the aromatic primary amine developing agent.

11. The photosensitive material of claim 1, wherein said green-sensitive layer is composed of a green-sensitive layer serving tone reproduction in the lowest density portion and a green-sensitive layer serving tone reproduction in the highest density portion, and said two green-sensitive layers contain said coupler of the general formula (I) and a 5-pyrazolone magenta coloring coupler, said 5-pyrazolone magenta coloring coupler providing at least 70% of the color density of the green-sensitive layer serving tone reproduction in the highest density portion, and said coupler of the general formula (I) providing at least 70% of the color density of the green-sensitive layer serving tone reproduction in the lowest density portion.

* * * * *